US007984910B1

(12) United States Patent
Nielsen

(10) Patent No.: US 7,984,910 B1
(45) Date of Patent: Jul. 26, 2011

(54) MOBILE DISC GOLF TARGET

(76) Inventor: Dana G. Nielsen, Island Lake, IL (US)

( * ) Notice: Subject to any disclaimer, the term of this patent is extended or adjusted under 35 U.S.C. 154(b) by 0 days.

(21) Appl. No.: 11/249,702

(22) Filed: Oct. 13, 2005

(51) Int. Cl.
*A63B 63/00* (2006.01)

(52) U.S. Cl. ..... 273/359; 273/400

(58) Field of Classification Search ..... 446/454–456; 273/398–402, 359; 473/192
See application file for complete search history.

(56) References Cited

U.S. PATENT DOCUMENTS

| | | | | |
|---|---|---|---|---|
| 2,679,712 | A * | 6/1954 | Schwien et al. | 446/443 |
| 3,231,280 | A | 1/1966 | Collins | |
| 3,303,821 | A | 2/1967 | Harris | |
| 3,559,994 | A | 2/1971 | Larsen | |
| 3,573,867 | A | 4/1971 | Mehrens | |
| 4,007,646 | A * | 2/1977 | De Jonge | 74/501.6 |
| 4,126,312 | A | 11/1978 | Kreuzer et al. | |
| 4,202,547 | A * | 5/1980 | Mueller | 473/161 |
| 5,048,845 | A | 9/1991 | Dunipace | |
| 5,265,686 | A | 11/1993 | Machen | |
| 5,273,480 | A * | 12/1993 | Suto | 446/456 |
| 5,303,931 | A | 4/1994 | Brown | |
| 5,338,247 | A * | 8/1994 | Miles | 446/456 |
| 5,397,130 | A | 3/1995 | Brown | |
| 5,597,165 | A * | 1/1997 | Rundle et al. | 273/442 |
| 5,711,388 | A | 1/1998 | Davies et al. | |
| 5,868,395 | A | 2/1999 | Headrick | |
| 5,921,551 | A | 7/1999 | Dunipace | |
| 5,944,132 | A | 8/1999 | Davies et al. | |
| 5,947,477 | A * | 9/1999 | Turnipseed | 273/407 |
| 5,980,392 | A * | 11/1999 | Cox | 473/192 |
| 6,024,627 | A * | 2/2000 | Tilbor et al. | 446/456 |
| 6,398,662 | B1 | 6/2002 | Cox | |
| 6,404,159 | B1 | 6/2002 | Cavallini | |
| 6,494,455 | B1 * | 12/2002 | Headrick | 273/400 |
| 6,692,385 | B2 * | 2/2004 | Walker et al. | 473/447 |
| 6,808,176 | B2 | 10/2004 | Billig et al. | |
| 6,813,548 | B2 | 11/2004 | Matsumoto et al. | |
| 6,881,122 | B2 | 4/2005 | Bloch et al. | |
| 6,948,713 | B1 | 9/2005 | Grunfield | |
| 2003/0148703 | A1 * | 8/2003 | Scott et al. | 446/456 |
| 2003/0236140 | A1 | 12/2003 | Alford | |
| 2007/0052178 | A1 * | 3/2007 | Cottrell | 273/402 |

OTHER PUBLICATIONS

Innova Disc Golf Target On-line Brochure, Dec. 2004, pp. 1-2, http://www.innovadiscs.com/discatcher/index.html.
"A Guide to Disc Golf from the PDGA," On-line Article, Dec. 2004, pp. 1-2, http://www.pdga.com/information.php.
"Guidelines & Procedures for Manufacturers to Certify that Equipment Complies with PDGA Technical Standards," PDGA Techical Standards Brochure, May 6, 2004, pp. 1-7.

(Continued)

*Primary Examiner* — Mark S Graham
(74) *Attorney, Agent, or Firm* — David A. Gottardo, Atty at Law

(57) ABSTRACT

A mobile disc golf target comprising a vehicle carrying a disc golf target assembly. A propulsion means and a steering means are operably associated with the vehicle, with the propulsion means operable to propel the vehicle across a surface and the steering means operable to direct the vehicle across the surface. A controller receives instructions from a command and is operably associated with the propulsion means and steering means of the vehicle to influence the vehicle's speed and direction. The steering means of the mobile platform may comprise a differential steering arrangement or a conventional steering arrangement. The controller may receive instructions from a command comprising wireless or tethered user-operated or computer-operated transmitter. A connector facilitates the removable attachment of the target assembly to the vehicle and may be self-righting to ensure that the target assembly remains substantially upright when the vehicle traverses non-level terrain.

34 Claims, 18 Drawing Sheets

OTHER PUBLICATIONS

"PDGA Approved Golf Discs and Disc-Catching Targets," PDGA Brochure, Oct. 7, 2004, pp. 1-5.
Tuffts, "And Then Some," On-line Article Regarding Remotely Controlled Vehicle, Jul. 2005, pp. 1-2, http://www.robotics.com/robomenu/andthen.html.
Cerjak, "Build It Yourself Transmission for Use in Radio Controlled Tanks & Other Tracked Vehicles," Nov. 12, 2004, pp. 2-4, http://www.rctransmission.com/CT1.htm.
McGuigan et al., "A review of Transmission Systems for Tracked Military Vehicles," Journal of Battlefield Technology, Nov. 1998, vol. 1, No. 3, abstract.
"Suspension and Steering Systems Operation," On-line Article, Jan. 2005, pp. 1-5, http://www.autoshop-online.com/auto101/susp.html.
Johns, "Tracked Vehicle Steering," On-Line Article, Jan. 2005, pp. 1-8, http://www.gizmology.net/tracked.htm.
Clark, "T-20 Transmission," Online Article, Jan. 2005, pp. 1-3, http://www.route6x6.com/t20/t20index.html.
Torrens, "4QD-TEC: Electronics Circuits Reference Archive PWM Speed Control," Online Article, Dec. 11, 2004, pp. 1-12, http://www.4qdtec.com/pwm-01.html.
Torrens, "Answers to FAQs on Battery Motors and Controllers," Online Article, Jun. 4, 2004, part 1, pp. 1-13, http://www.4qd.co.uk/faq/bmnc1.html#12v.
Torrens, "Answers to FAQs on Battery Motors and Controllers," Online Article, Jan. 3, 2005, part 2, pp. 1-12, http://www.4qd.co.uk/faq/bmnc2.html#cycles.
Torrens, "Answers to FAQs on Battery Motors and Controllers," Online Article, Dec. 23, 2004, part 3, pp. 1-13, http://www.4qd.co.uk/faq/bmnc3.html#machines.
Torrens, "Answers to FAQs on Battery Motors and Controllers," Online Article, Oct. 5, 2004, part 4, pp. 1-12, http://www.4qd.co.uk/faq/bmnc4.html#remcon.
"Definition of Steering," On-line Article, Jan. 2005, pp. 1-3, http://www.wordiq.com/definition/Steering.
Innova Disc Golf Target On-line Brochure, Sep. 2004, pp. 1-2, http://www.innovadiscs.com/discatcher/index.html.
Grafstein et al., "Servomechanisms," Pictorial Handbook of Technical Devices, 1971, pp. 270-271.
Moyer, "Radio-Controlled Lawn Mowers," On-line Article, Jul. 2005, pp. 1-4, http://www.webcom.com/sknkwrks/mowers.htm.
Author Unknown: DGA Disc Pole Holes Disc Golf Baskets, Jan. 27, 2008, http://www.discgolfassoc.com/poleholes.html.
Headrick: An Abbreviated History of Disc Golf, Jan. 27, 2008, http://www.discgolfassoc.com/history.html.

* cited by examiner

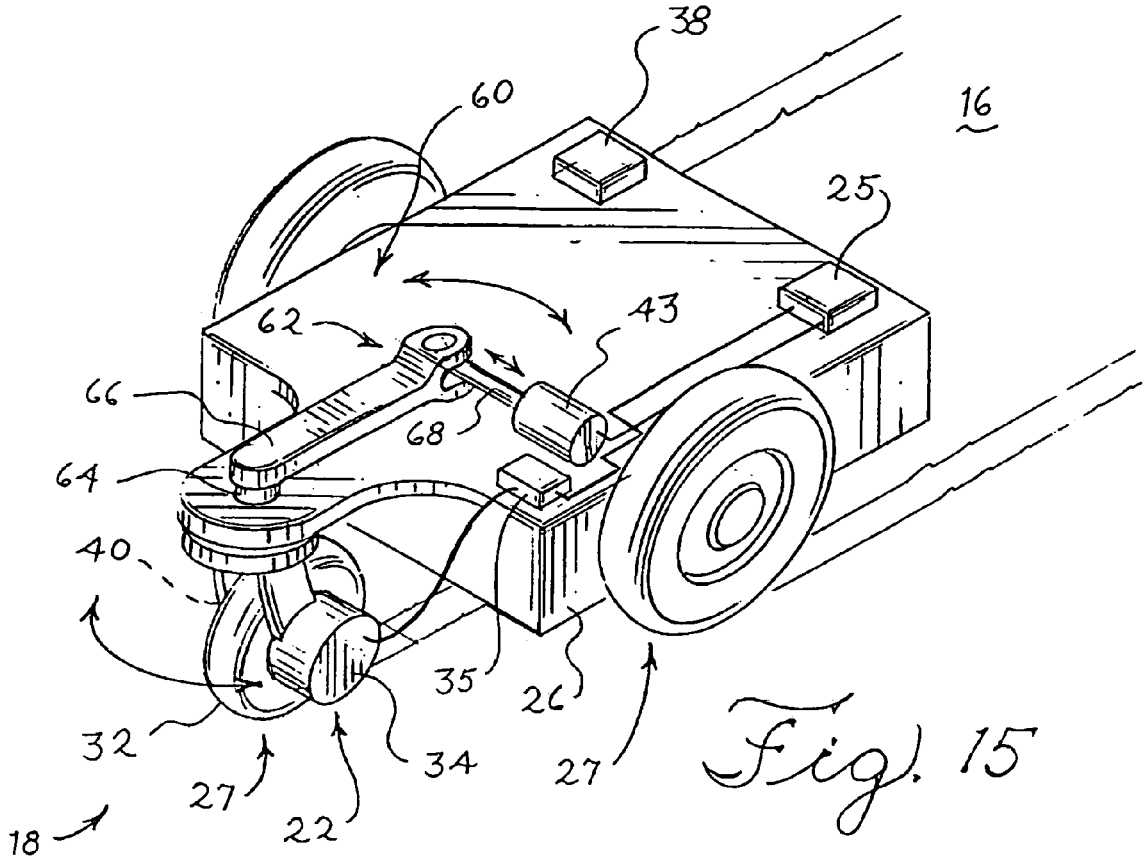
Fig. 15
Fig. 32
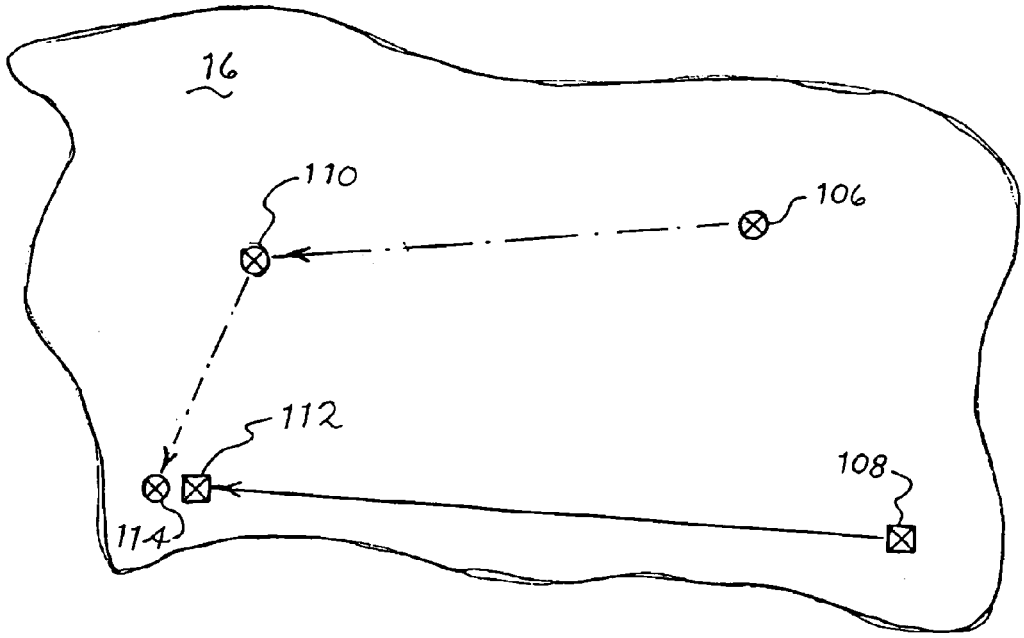

FIG. 20

| LEFT CONTROL POSITION | RIGHT CONTROL POSITION | VEHICLE MOTION |
|---|---|---|
| F | F | FORWARD |
| R | R | REVERSE |
| N | N | NEUTRAL-STOP/REMAIN IN FIXED LOCATION |
| NF | NF | REDUCED SPEED FORWARD |
| NR | NR | REDUCED SPEED REVERSE |
| F | NF | FORWARD RIGHT TURN |
| NF | F | FORWARD LEFT TURN |
| R | NR | REVERSE RIGHT TURN |
| NR | R | REVERSE LEFT TURN |
| F | R | CLOCKWISE ROTATION IN PLACE |
| R | F | COUNTER-CLOCKWISE ROTATION IN PLACE |
| F | N | FORWARD RIGHT PIVOT |
| R | N | REVERSE RIGHT PIVOT |
| NF | N | REDUCED SPEED FORWARD RIGHT PIVOT |
| NR | N | REDUCED SPEED REVERSE RIGHT PIVOT |
| N | F | FORWARD LEFT PIVOT |
| N | R | REVERSE LEFT PIVOT |
| N | NF | REDUCED SPEED FORWARD LEFT PIVOT |
| N | NR | REDUCED SPEED REVERSE LEFT PIVOT |

FIG. 21

| LEFT CONTROL POSITION | RIGHT CONTROL POSITION | VEHICLE MOTION |
|---|---|---|
| F | N | FORWARD STRAIGHT-LINE |
| R | N | REVERSE STRAIGHT-LINE |
| N | | NEUTRAL-STOP/REMAIN IN FIXED LOCATION |
| NF | N | REDUCED SPEED FORWARD STRAIGHT-LINE |
| NR | N | REDUCED SPEED REVERSE STRAIGHT-LINE |
| F | Rt | FORWARD RIGHT TURN |
| F | Lt | FORWARD LEFT TURN |
| NF | Rt | REDUCED SPEED FORWARD RIGHT TURN |
| NF | Lt | REDUCED SPEED FORWARD LEFT TURN |
| R | Rt | REVERSE RIGHT TURN |
| R | Lt | REVERSE LEFT TURN |
| NR | Rt | REDUCED SPEED REVERSE RIGHT TURN |
| NR | Lt | REDUCED SPEED REVERSE LEFT TURN |

MOBILE DISC GOLF TARGET

TECHNICAL FIELD OF THE INVENTION

This invention relates generally to disc golf targets, and more particularly to mobile disc golf targets comprising a mobile platform used in connection with a disc golf target assembly for directing and moving it across a surface.

BACKGROUND OF THE INVENTION

Disc golf is a sporting activity rapidly gaining in popularity. The game of disc golf is similar to that of golf itself. However, instead of hitting a golf ball with a club to direct the ball toward a given hole that catches the ball, a disc golf participant throws a flying disc (i.e. a Frisbee®) at a target that catches or entraps the disc. Similar to having a number of holes arranged in an open playing area as in a traditional golf game, a plurality of targets are arranged in an open playing area for a disc golf game. The playing area for a disc golf game may include a predetermined number of disc golf targets arranged numerically within the playing area, with each target assigned a level of difficulty or par.

After making a first disc throw at the first disc golf target within the playing area, (i.e. teeing off from a tee area or tee box), the disc golf participant makes consecutive throws towards the first target until the disc is entrapped by the target itself. After the disc is entrapped by the first target, the participant moves to the next tee box and then throws the disc towards the second target, again making consecutive throws until the disc is entrapped. Then, in consecutive order, the participant moves to remaining tee boxes and throws towards the remaining targets within the playing area until the disc is finally entrapped by the final numerical target. As in the traditional game of golf, the disc golf participant strives for the goal of having the fewest total number of throws towards each target within the playing area.

A typical disc golf target is an assembly that preferably includes a stand having an upper end supporting a basket, and a plurality of loosely hanging chains disposed above the basket. The chains are functionally arranged to effectively catch a flying disc by absorbing the disc's kinetic energy, with the disc thereafter dropping into the basket. Disc golf target assemblies are typically stationary, with a lower end of the stand typically terminating in a base, such as a pedestal, concrete pad or tripod. To move the target assembly from one location to another within a given playing area, the assembly must be picked up and manually carried or transported between locations.

Having to manually carry or transport the disc golf target assembly from one location to another can be cumbersome or physically demanding due to the size and weight of the target itself. "Lightweight," portable models can weigh between 20 and 40 pounds while more permanent assemblies can have twice the weight of the portable devices. Although some disc golf target assemblies may incorporate wheels within their base to aid in their movement from one location to another and other targets may be disassembled and/or folded for ready transport, such targets are nonetheless cumbersome to move.

Furthermore, because a disc is thrown at a target from a distance, one must walk over to the target to move it from one location to another. Having to walk over to the target during a disc golf game or practice session, to manually move the target assembly from one location to another, thus interrupts the game or practice session itself. This manual moving of the target assembly often doubles the time it takes for a participant to complete a given disc golf course. The present invention thus overcomes the above shortcomings by relieving a disc golf participant from having to manually carry or transport the target assembly between locations, thus reducing the time it takes for a participant to complete the course.

SUMMARY OF THE INVENTION

The present invention generally relates to disc golf targets, and more particularly to mobile disc golf targets comprising a mobile platform used in connection with a disc golf target assembly for directing and moving the target assembly across a surface (i.e. the playing surface of a disc golf course). The mobile platform comprises a vehicle for carrying the target assembly. The target assembly may be connected to the vehicle, preferably with a connector located on the vehicle, to facilitate a removal or disconnection of the target assembly from the vehicle. The connector may also be self-righting to ensure that the assembly remains substantially vertical when the playing surface is non-level.

A propulsion means and a steering means are operably associated with the vehicle for propelling and directing the vehicle across the surface. A controller is operably associated with the propulsion and steering means for influencing the speed and direction of the vehicle. The controller receives instructions from a command, preferably comprising a wireless or tethered user-operated transmitter and/or a programmable computer-operated transmitter.

The vehicle includes a chassis having a plurality of supports, movably associated therewith, that communicate with the playing surface. In the preferred embodiments of the invention, the supports may comprise wheels or tread assemblies suitable for use with various types of terrain. The steering means of the vehicle may comprise a differential steering arrangement or a conventional steering arrangement.

Utilizing the differential steering arrangement, the vehicle comprises a chassis having a plurality of supports movably associated therewith and in communication with the surface, with at least two supports operably associated with the propulsion means. The differential steering arrangement comprises a rotation changer operably associated with the propulsion means and at least one support of the at least two supports, with the supports comprising either wheels or tread assemblies.

In one embodiment of the invention utilizing a differential steering arrangement, the propulsion means comprises at least one motor operably associated with each of the at least two supports. The rotation changer comprises at least one motor control operably associated with the at least one motor. The at least one motor control is under the influence of the controller and is operable to vary the speed and direction of the at least one motor to effect a change in speed and direction on the associated support (i.e. wheel or tread assembly). For purposes of maneuvering the vehicle, the motors are capable of variations in rotational speed and direction, with such variations being controlled by the at least one motor control, and are preferably connected to respective wheels or tread assemblies via shafts.

In another embodiment of the invention utilizing a differential steering arrangement, the rotation changer comprises a transmission operably associating the at least two supports of the vehicle to the propulsion means. The transmission and propulsion means are under the influence of the controller, with the transmission operable to change the rotational speed and direction of at least one support to effect a change in speed and direction of the vehicle. The transmission preferably has one input shaft for receiving input rotational energy from a power source (i.e. propulsion means) and two output shafts that transmit and vary the output rotational energy from the transmission to at least a pair of wheels or tread assemblies.

In addition to the one or more wheels or tread assemblies comprising the supports driven by the propulsion means, non-driven supports may also be utilized to provide additional support to the vehicle as well. Such non-driven supports may include one or more skids or wheels associated with the chassis.

In embodiments of the vehicle utilizing a conventional steering arrangement, the vehicle comprises a chassis having a plurality of supports movably associated therewith and in communication with the surface while the conventional steering arrangement comprises a direction changer. The direction changer is under the influence of the controller and operable to adjust the angular orientation of at least one support in relation to the chassis to effect a change in direction of the vehicle. Simple tiller-type systems, rack-and-pinion configurations, pitman arm assemblies, recirculating ball systems, or other steering configurations commonly known in the art may be utilized as the direction changer to change the direction of the vehicle.

The controller utilizes conventional commercial electronics understood in the art to receive instructions from the command and transmit them to the propulsion and steering means of the vehicle to control the vehicle's starting and stopping movements, as well as the vehicle's speed and direction. In one embodiment of the invention, the command, which instructs the controller, comprises a remote, wireless user-operated transmitter. A hard-wire cable (i.e. a tether) having a pre-determined length may also be used in place of the wireless connection to the controller for transmitting instructs to the vehicle as well.

In another embodiment of the invention, the command comprises a programmable computer-operated transmitter for instructing the controller. The computer-operated transmitter may be located on-board the vehicle itself or located remotely of the vehicle, with the remotely-located computer transmitting instructions to the vehicle's controller via a wireless or hard-wired (i.e. tethered) means of data transmission.

Regardless of its location, the computer-operated transmitter may be programmed by the owner or user of the mobile disc target, or may be pre-programmed by the manufacturer or retail seller of the device. The computer-operated transmitter may also accept downloaded programs from third-party providers similar to games downloaded to television or computer video games with game cartridges or other media.

With regard to a connection of the target assembly to the vehicle, the target assembly is connected to the vehicle with a connector preferably located on the chassis, or on a rigid cover removably attached to the chassis. The connector may be configured for removable engagement with the assembly and in one embodiment may connect to a lower end of the assembly's stand. In yet another embodiment of the invention, the connector may be self-righting via a multidirectional pivot that enables the target assembly to remain upright (i.e. substantially vertical) when the mobile platform is traversing a non-level surface.

In addition to having the connector located thereon for connecting the target assembly to the vehicle, the cover and/or chassis may also be adapted to hold and carry various accessories as well.

In use, the target assembly is connected to the vehicle at the connector if not already pre-connected thereto. The vehicle and/or command are then energized through the actuation of respective on/off switches or similar devices. For moving and directing the mobile disc golf target across the playing surface, a command is operated for creating instructions that control the speed and direction of the vehicle carrying the assembly. Instructions are then transmitted via the command and from the command to the controller of the vehicle. Via the instructions created with the command, the propulsion and steering means of the vehicle are influenced by the controller to move and direct the mobile disc golf target to at least one location on the playing surface.

In use in an embodiment of the invention having a user-operated transmitter for the command, controls, switches, control sticks and/or control wheels are manipulated to create instructions that control the speed and direction of the vehicle. In use in an embodiment of the invention having a computer-operated transmitter for the command, the computer is programmed by a disc golf participant or other individual or party, or receives a program downloaded by the same from another computer or from a portable medium such as a floppy disc, cartridge or memory card, or from a CD ROM. The computer is then operated to execute the program to create instructions that control the speed and direction of the vehicle.

BRIEF DESCRIPTION OF THE DRAWINGS

FIG. 15 is a schematic perspective view of an embodiment of the vehicle utilizing a conventional steering arrangement having one wheel associated with the propulsion means and direction changer;

FIG. 20 is a table setting forth the various control positions of a user-operated transmitter for operation of embodiments of the invention utilizing a differential steering arrangement;

FIG. 21 is a table setting forth the various control positions of a user-operated transmitter for operation of embodiments of the invention utilizing a conventional steering arrangement;

FIG. 32 is an aerial schematic view of a disc golf playing course showing various locations of the mobile disc golf target and tee box on the playing surface.

DESCRIPTION OF THE PREFERRED EMBODIMENTS

Figure 1:
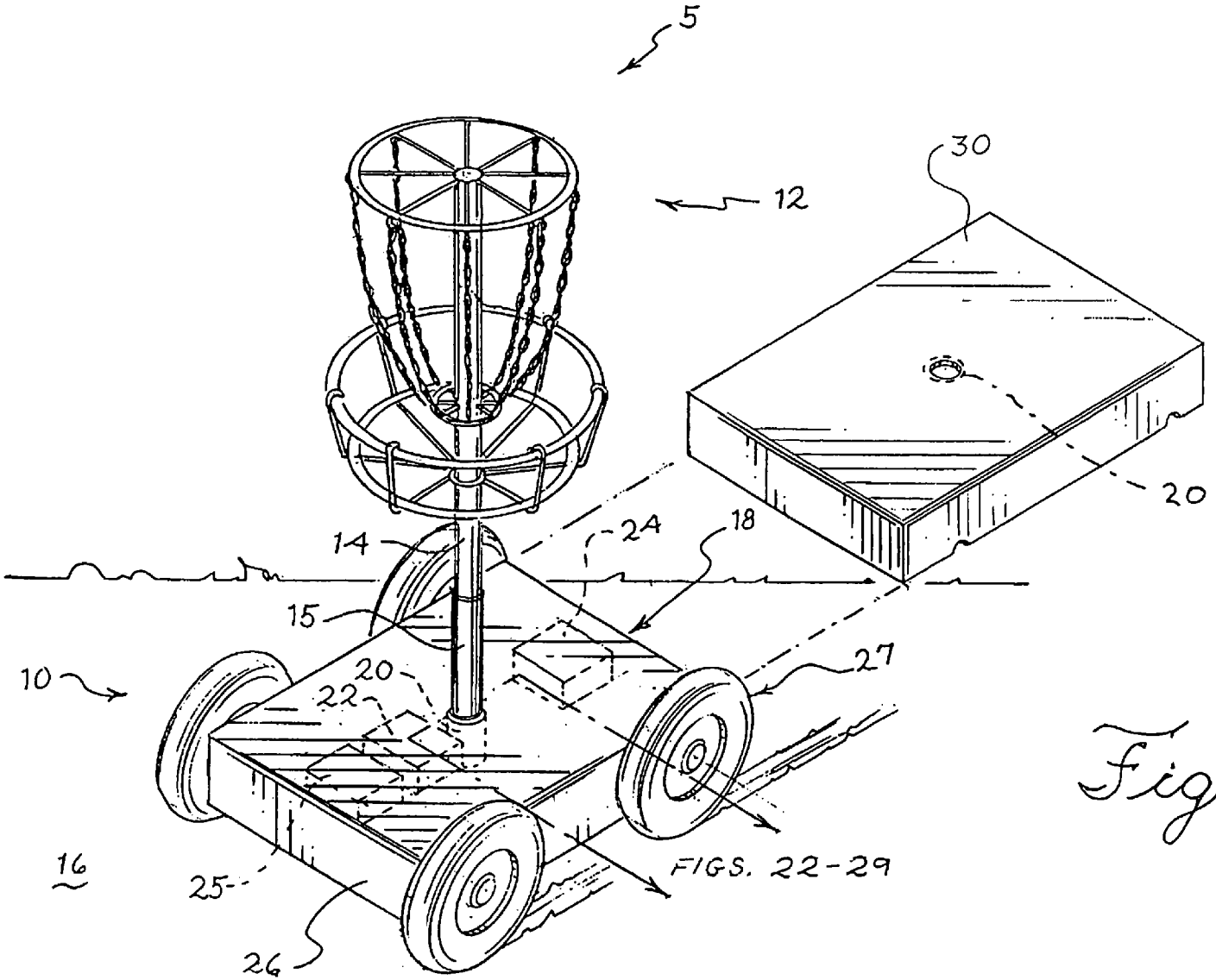
FIG. 1 is a schematic perspective view of one embodiment of the mobile platform and target assembly with optional cover.

The present invention generally relates to disc golf targets, and more particularly to mobile disc golf targets comprising a mobile platform used in connection with a disc golf target assembly for directing and moving it across a surface. FIG. 1 is a schematic perspective view illustrating the basic components of a mobile disc golf target 5 comprising a mobile platform 10 used in connection with a disc golf target assembly 12 preferably having a stand 14 or other upright structure. The stand 14 may include a height adjustment mechanism 15 whereby the stand includes at least two sections in adjustably lockable telescopic relation to one another.

The mobile platform 10 carries the target assembly 12 and facilitates the transport of the assembly across a surface 16 (i.e. the playing surface of a disc golf playing course). In one embodiment of the invention illustrated within FIG. 1, the mobile platform 10 comprises a vehicle 18 for carrying the target assembly 12, with the vehicle preferably connected to the stand 14 of the target assembly 12 by a connector 20 located on the vehicle.

The connector 20, to be discussed further, may facilitate a removal or disconnection of the target assembly 12 from the vehicle 18 and may be self-righting to ensure that the assembly remains substantially vertical when the playing surface 16 is non-level. Although FIG. 1 illustrates vehicle 18 connected to a stand 14 of the target assembly 12, it is understood that a target assembly not having a stand may be connected to the vehicle with or without connector 20 as well. Furthermore, although FIG. 1 illustrates the stand 14 as a pole, the stand may comprise any upright structure, to include a barrel, stanchion, pylori, pillar, pedestal, etc.

A propulsion means 22 and a steering means 24 are operably associated with the vehicle 18 for propelling and directing the vehicle across the surface 16. A controller 25 is operably associated with the propulsion and steering means 22 and 24 for influencing the speed and direction of the vehicle 18. The controller 25, to be further discussed, receives instructions from a command (not shown in FIG. 1 and to be further discussed) comprising a wireless or tethered user-operated or computer-operated transmitter.

The vehicle 18 includes a frame or chassis 26 having a plurality of supports 27 movably associated therewith that communicate with the playing surface 16. The chassis 26 may comprise any rigid structure capable of supporting the target assembly, propulsion and steering means, supports, and other electrical and mechanical components. The chassis 26 may be comprised of various materials suitable for providing structural rigidity to the vehicle 18, to include various ferrous and non-ferrous metals, alloys, plastics, carbon-fiber, wood, etc. An optional cover 30, adapted to fit the chassis 26, may be located thereon for shielding any exposed components from the elements.

The cover 30, preferably attached to the chassis via bolts, clips or other similar fasteners, may be comprised of plastic, fiberglass, steel, aluminum, or any similar materials and should have a rigidity to carry the target assembly 12, optionally using the connector 20 supported by the cover, to be discussed further. In the preferred embodiments of the invention, the supports 27 may comprise wheels or tread assemblies suitable for use with various types of terrain. The steering means 24 of the vehicle 18 may comprise a differential steering arrangement or a conventional steering arrangement.

A differential steering arrangement is generally utilized by tracked vehicles (i.e. bulldozers or battle tanks) to bring about a change in course or direction. To steer with such an arrangement, one track of the vehicle is made to rotate faster or slower than the other track located on the opposite side of the vehicle, thus causing the vehicle to turn in the direction of the slower rotating track. Multi-wheeled vehicles (i.e. six-wheeled all terrain vehicles) also commonly utilize a differential steering arrangement. Similar to a tracked vehicle, one set of wheels is made to rotate faster or slower than the other set located on the opposite side of the vehicle, thus causing the vehicle to turn in the direction of the slower rotating wheels.

A conventional steering arrangement is generally utilized by automobiles and other common wheeled vehicles. In a conventional steering arrangement, the change in direction of the vehicle results from a change in angular orientation of one or more wheels in relation to the vehicle while the vehicle is in motion. As the present invention may utilize either a differential or conventional steering arrangement, a more detailed discussion of the various embodiments utilizing these arrangements thus follows.

FIGS. 2, 3, 5-8 and 11-14 each illustrate an embodiment of the vehicle 18 utilizing a differential steering arrangement 28. For the sake of clarity, neither the target assembly 12 nor the connector 20 are illustrated therein. As illustrated within each of the figures, the vehicle 18 comprises a chassis 26 having a plurality of supports 27 movably associated therewith and in communication with the surface 16. The supports 27 are supported by and, in turn, support the chassis 26. At least two supports 27 of the plurality are operably associated with the propulsion means 22, with the propulsion means and differential steering arrangement 28 preferably also supported by the chassis 26. The differential steering arrangement 28 within these figures comprises a rotation changer 31 operably associated with the propulsion means 22 and at least one support 27 of the at least two supports to vary the speed and direction of the at least one support, thus effecting a change in the speed and direction of the vehicle 18. The supports 27 within the embodiments of these figures may comprise either wheels 32 or tread assemblies 33.

Figure 2:
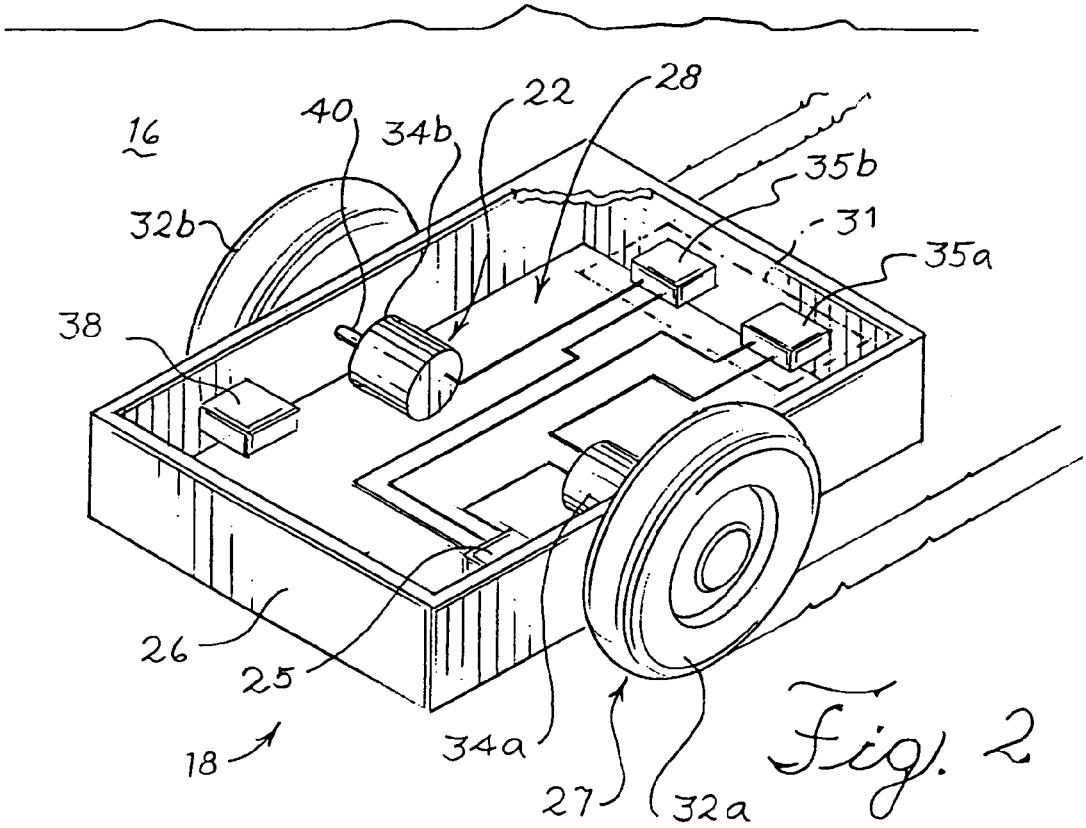
FIG. 2 is a schematic perspective view of an embodiment of the vehicle utilizing a differential steering arrangement and having motors and motor controls used in combination with wheels.
Figure 3:
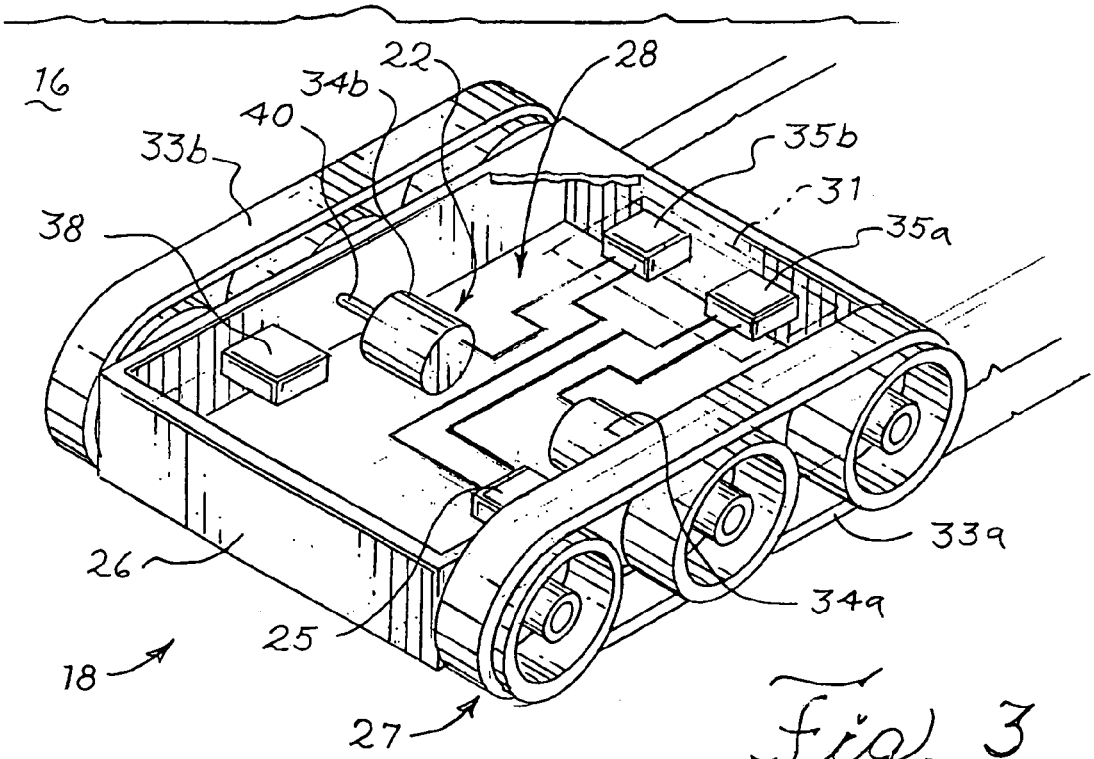
FIG. 3 is a schematic perspective view of an embodiment of the vehicle utilizing a differential steering arrangement and having motors and motor controls used in combination with tread assemblies.

Referring to FIGS. 2 and 3, the propulsion means 22 comprises at least one motor 34 (motors 34*a* and 34*b*, respectively) operably associated with each of the at least two supports 27. FIG. 2 illustrates an embodiment of the vehicle 18 where the supports 27 comprise wheels 32*a* and 32*b* while FIG. 3 illustrates an embodiment where the supports 27 comprise tread assemblies 33*a* and 33*b*. In both of these embodiments, the rotation changer 31 comprises at least one motor control 35 (controls 35*a* and 35*b*) that is operably associated with the at least one motor 34 (motors 34*a* and 34*b*). The at least one motor control 35 is under the influence of the controller 25 and is operable to vary the speed and direction of the at least one motor 34 to vary the speed and direction of the associated support, thus effecting a change in the speed and direction of the vehicle 18.

The motors 34*a* and 34*b* utilized within the vehicle 18 are electric and have the power capable of moving the weight of the mobile platform 10 and attached target assembly 12 over varied terrain typical of disc golf courses. In the preferred embodiment of the invention, permanent magnet motors are utilized because of their voltage-dependent top speed. If a permanent magnet motor tries to free-wheel faster than its top speed (i.e. as the vehicle travels down and incline), the motor will act to brake itself, thus making it ideal for use in the present invention where speed is to be controlled at all times. Of course, for purposes of maneuvering the vehicle 18, the motors 34*a* and 34*b* are capable of variations in rotational speed and direction, with such variations being controlled by the at least one motor control.

FIGS. 2 and 3 illustrate one motor control associated with each of two motors. Thus, for wheels 32*a* and 32*b* or tread assemblies 33*a* and 33*b* located opposite one another on the chassis 26, the motor controls 35*a* and 35*b* can vary the rotational speed and direction of their respective motors 34*a* and 34*b* independently of one another to optimize the maneuverability of the vehicle 18. While the figures associate each motor control with only one motor of the vehicle to effect a change in speed and direction of the associated wheel or tread assembly, it is understood that a single motor control may be utilized to vary the rotational speed and direction of both of the two motors of the vehicle.

Figure 4:
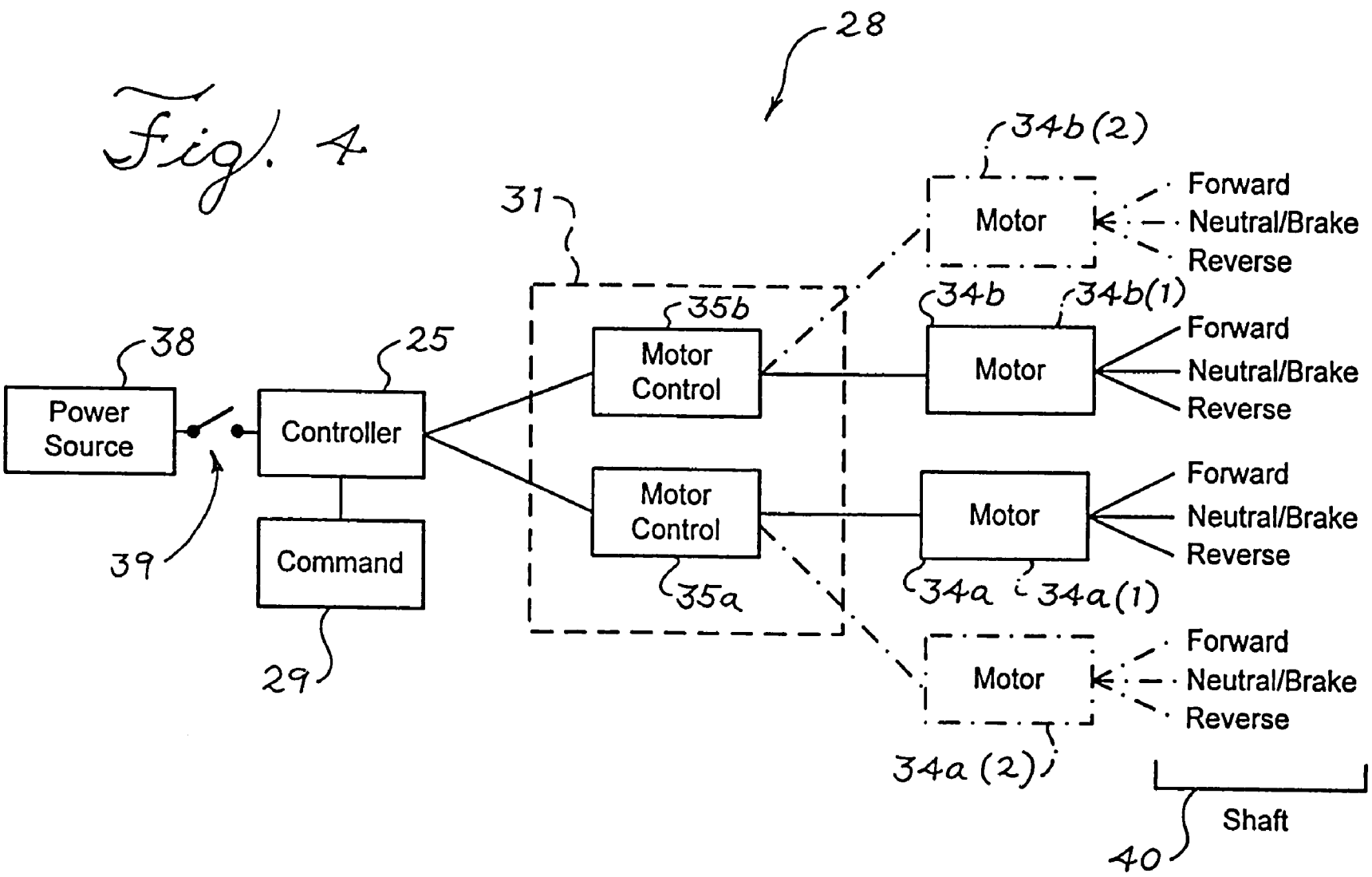
FIG. 4 is a block diagram of an electrical circuit for embodiments of the vehicle utilizing a differential steering arrangement having at least one motor control and motor as the rotation changer.

FIG. 4 is a block diagram illustrating the basic electrical components of the differential steering arrangement 28 wherein the rotation changer 31 comprises at least one motor control 35 (i.e. controls 35*a* and 35*b*) operably associated with the at least one motor 34 (i.e. motors 34*a* and 34*b*). The at least one motor control is under the influence of controller 25, with the controller receiving input instructions or commands from command 29. The at least one motor control 35 is comprised of common electrical devices understood in the art to vary the rotational speed and direction of a motor. Such devices may include rheostats or stepped rotary switches, for example, to vary motor speed via a regulation of the electrical current fed to the motor. Numerous switches (i.e. double-pole changeover switch) and/or relays understood in the art may be utilized to reverse the current to the motor to effect a change in direction of motor rotation. Various commercially available circuits or microprocessors may also be utilized as the motor control to vary the motor's rotational speed and direction as well.

The controller 25 is preferably a microprocessor-based controller routinely used by hobbyists and the like in controlling model cars and similar vehicles. The controller is adapted to receive instructions from command 29, to be discussed further, and forward the instructions to the other electrical components of the vehicle. The controller, motor controls and motors may operate from a 12, 24 or 36 volt power source, depending on the level of power needed to move and operate the vehicle.

Although the controller, motor controls and motors may derive their power from a 12, 24, or 36 volt AC power source, in the preferred embodiment of the invention, they derive their power from a battery 38. Battery 38, preferably supported by the chassis 26, may comprise one or more storage cells known in the art as providing electrical energy to drive motors and related components used, for example, in common golf carts and similar vehicles. Battery 38 may be energized utilizing a standard battery charger and AC power source or by utilizing solar cells (not shown) mounted to the vehicle 18 or target assembly 12. An on/off switch 39 or similar mechanism is preferably utilized between the battery and remaining electrical components to energize and de-energize the vehicle accordingly.

Referring again to FIGS. 2 and 3, the motors 34*a* and 34*b* are connected to respective wheels 32*a* and 32*b* or tread assemblies 33*a* and 33*b* via shafts 40. Thus, when energized by the battery 38 (illustrated in the figures with the wires omitted for clarity), the motors rotate shafts 40 to impart a rotational motion on the wheels or tread assemblies of the vehicle, thereby propelling the vehicle across the surface. While, for the sake of example, the figures illustrate the motors 34 connected to respective wheels 32 or tread assemblies 33 via shafts 40, it is understood that the motors may be connected to the respective wheels or tread assemblies via various other energy transfer arrangements well known in the art, to include gears, belts, chain drives, or various combinations thereof. Such other energy transfer arrangements may be utilized to increase or decrease the rotational speed of the wheel or tread assembly in relation to that of the motor.

Thus, under the influence of the at least one motor control 35, the rotational speed and direction of each motor 34 is variable to impart a predetermined rotational speed and direction on the respective wheels or tread assemblies. The motor controls may thus cause the motors independently to start or stop rotation, to increase or decrease their respective speeds of rotation, or to reverse rotational direction, thus imparting the instructed movement on the associated wheels or tread assemblies.

If the controller 25 influences the motor controls 35*a* and 35*b* to de-energize the motors 34*a* and 34*b*, the motors will not rotate, thus imparting no rotational energy on respective wheels 32*a* and 32*b* or tread assemblies 33*a* and 33*b*. Of course, the vehicle 18 will remain stationary when in this state. If the controller 25 influences the motor controls 35*a* and 35*b* to energize the motors 34*a* and 34*b* with the same level of electrical current, the motors will rotate at the same speed to impart a common rotational speed to respective wheels 32*a* and 32*b* or tread assemblies 33*a* and 33*b*. The vehicle 18 will thus move in a linear direction, assuming that the respective wheels or tread assemblies are of a common size in relation to one another. A reversal of both motors to a common rotational speed will cause the vehicle 18 to travel in a reverse, linear direction.

Conversely, if the controller 25 influences either of motor controls 35*a* and 35*b* to de-energize or reduce the electrical current to one of the motors 34*a* or 34*b*, a reduced rotational energy will be transmitted to the associated wheel or tread assembly, causing the vehicle 18 to travel in the direction of the slower wheel or assembly. Similarly, if the controller 25 influences either of motor controls 35*a* and 35*b* to increase the electrical current to one of the motors 34*a* or 34*b*, an increased rotational energy will be transmitted to the associated wheel (32*a* or 32*b*) or tread assembly (33*a* or 33*b*), again causing the vehicle 18 to travel in the direction of the slower wheel or assembly.

Furthermore, if the controller 25 influences either of motor controls 35*a* or 35*b* to completely de-energize the electrical current to the associated motor while the other motor remains energized, the wheel or tread assembly associated with the de-energized motor will stop moving while the other wheel or assembly continues to move, thus causing vehicle 18 to pivot about the stationary wheel or assembly. If the controller 25 influences the motor controls 35*a* and 35*b* to energize respective motors 34*a* and 34*b* in opposite directions of rotation, the associated wheels 33*a* and 33*b* or tread assemblies 33*a* and 33*b* will rotate in opposite directions, thus causing the vehicle 18 to rotate in place.

Figure 5:
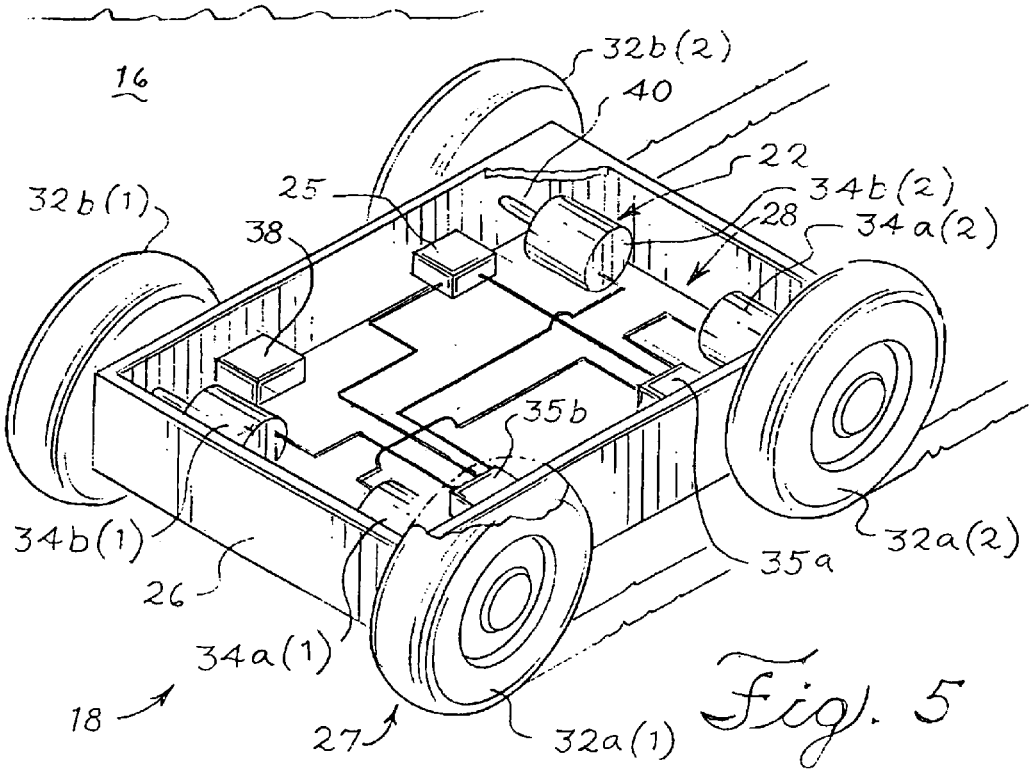
FIG. 5 is a schematic perspective view of another embodiment of the vehicle utilizing a differential steering arrangement, but having additional motors and motor controls used in combination with wheels.
Figure 6:
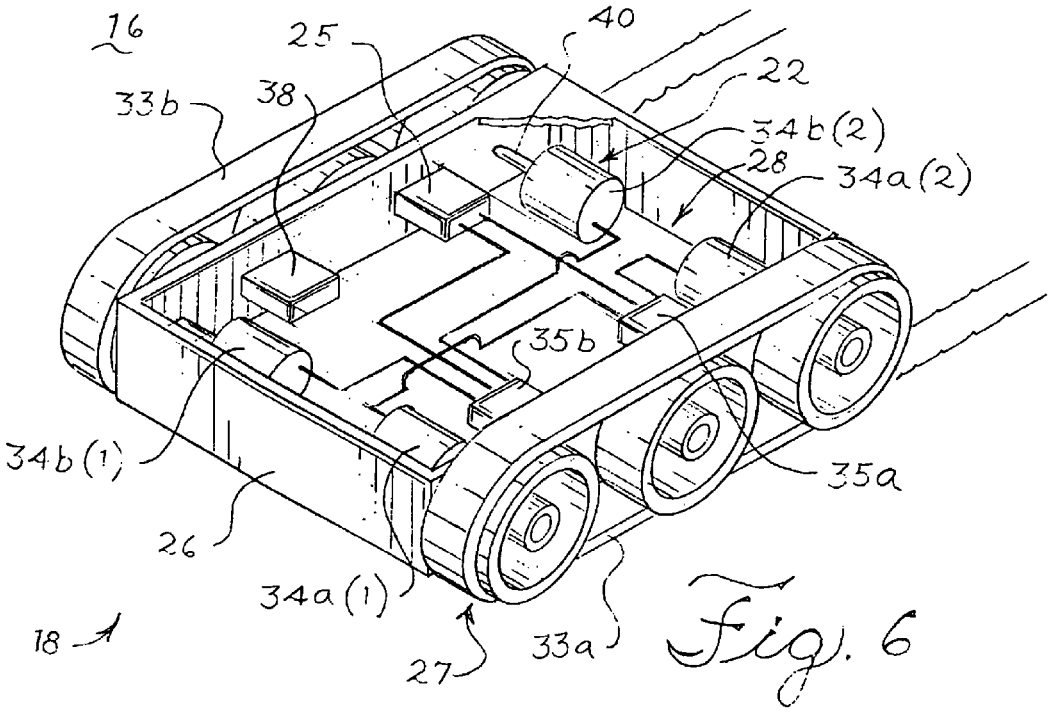
FIG. 6 is a schematic perspective view of another embodiment of the vehicle utilizing a differential steering arrangement, but having additional motors and motor controls used in combination with tread assemblies.

While FIG. 2 illustrates a vehicle 18 having two wheels 32*a* and 32*b* with associated motors 34*a* and 34*b*, it is understood that third, fourth or any number wheels and associated motors may be located on the chassis 26 as well. Similarly, while FIG. 3 illustrates a vehicle 18 having each tread assembly 33*a* and 33*b* associated with a respective single motor 34*a* and 34*b*, it is understood that any number of motors may be associated with a given tread assembly as well. FIG. 5 thus illustrates a vehicle 18 having four wheels 32*a*(1), 32*a*(2), 32*b*(1) and 32*b*(2) with four associated motors 34*a*(1), 34*a*(2), 34*b*(1) and 34*b*(2) while FIG. 6 illustrates a vehicle 18 having two tread assemblies 33*a* and 33*b* with the same motors in paired relationship. Similar to the embodiments of FIGS. 2 and 3, the motors are preferably connected to the respective wheels or tread assemblies with shafts 40.

The motors of these embodiments may undergo variations in speed and direction via at least one motor control under the influence of the controller 25. Thus, as illustrated in FIGS. 5 and 6, motor control 35*a* is paired with motors 34*a*(1) and 34*a*(2) while motor control 35*b* is paired with motors 34*b*(1) and 34*b*(2) to ensure that that the motors located on a common side of the vehicle 18 have a common rotational speed and direction. Such a commonality of speed and direction for the motors located on a common side of the vehicle ensures that a common speed and direction of the associated wheels or tread assemblies occurs, thus ensuring a proper direction of the vehicle 18.

The operation of the of the controls 35 and motors 34 to direct the vehicle 18 illustrated in these figures is thus similar to those illustrated in FIGS. 2 and 3, with both motors per common side of the vehicle receiving the same operational input from their respective motor controls. Referring again to FIG. 4, the additional motors 34*a*(2) and 34*b*(2) are illustrated within the block diagram in phantom as connected to motor controls 35*a* and 35*b*, respectively, with motors 34*a* and 34*b* denoted in phantom as 34*a*(1) and 34*b*(1) to differentiate them from motors 34*a*(2) and 34*b*(2).

Further embodiments of the vehicle 18 utilizing the differential steering arrangement 28 are illustrated in FIGS. 7, 8, 11 and 12. Within these embodiments, the rotation changer 31 of the differential steering arrangement 28 comprises a transmission 42 operably associating the at least two supports 27 to the propulsion means 22. The transmission 42 and propulsion means 22 are under the influence of the controller 25, with the transmission operable to vary the rotational speed and direction of at least one support 27 to effect a change in speed and direction of the vehicle 18. The transmission 42 may comprise any of the mechanical or electro-mechanical differential steering types understood in the art, to include clutch-brake, geared, braked differential, controlled differential, double differential, or triple differential steering transmissions.

Regardless of the specific type, each of the aforementioned transmissions has one input shaft for receiving input rotational energy from a power source (i.e. propulsion means 22) and two output shafts that transmit the output rotational energy from the transmission to at least a pair of wheels or tread assemblies. Each of the output shafts of the transmission are independently controllable to vary the rotational speed and direction of the rotational energy transmitted there-from. An example of a transmission suitable for use in the present device is a differential gearbox having a two bi-directional clutches, commonly known within the hobby industry for use in used in large-scale, radio controlled battle tanks.

Figure 7:
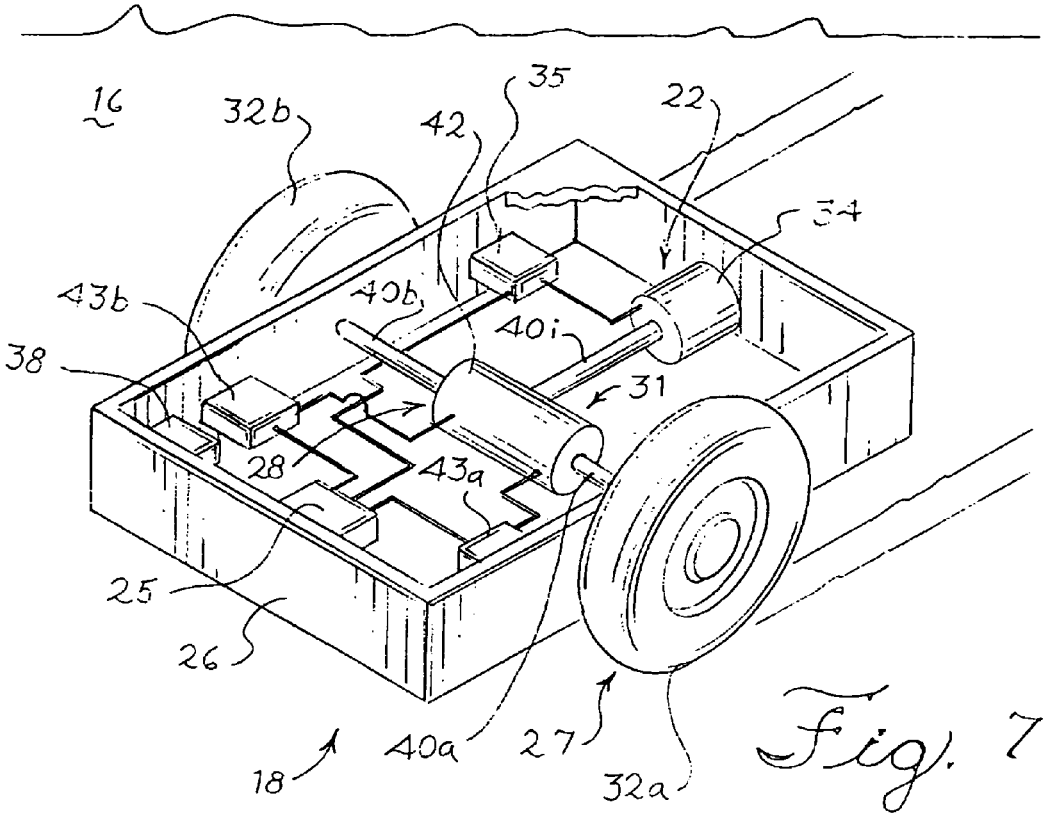
FIG. 7 is a schematic perspective view of an embodiment of the vehicle utilizing a differential steering arrangement having a propulsion means and transmission used in combination with wheels.
Figure 8:
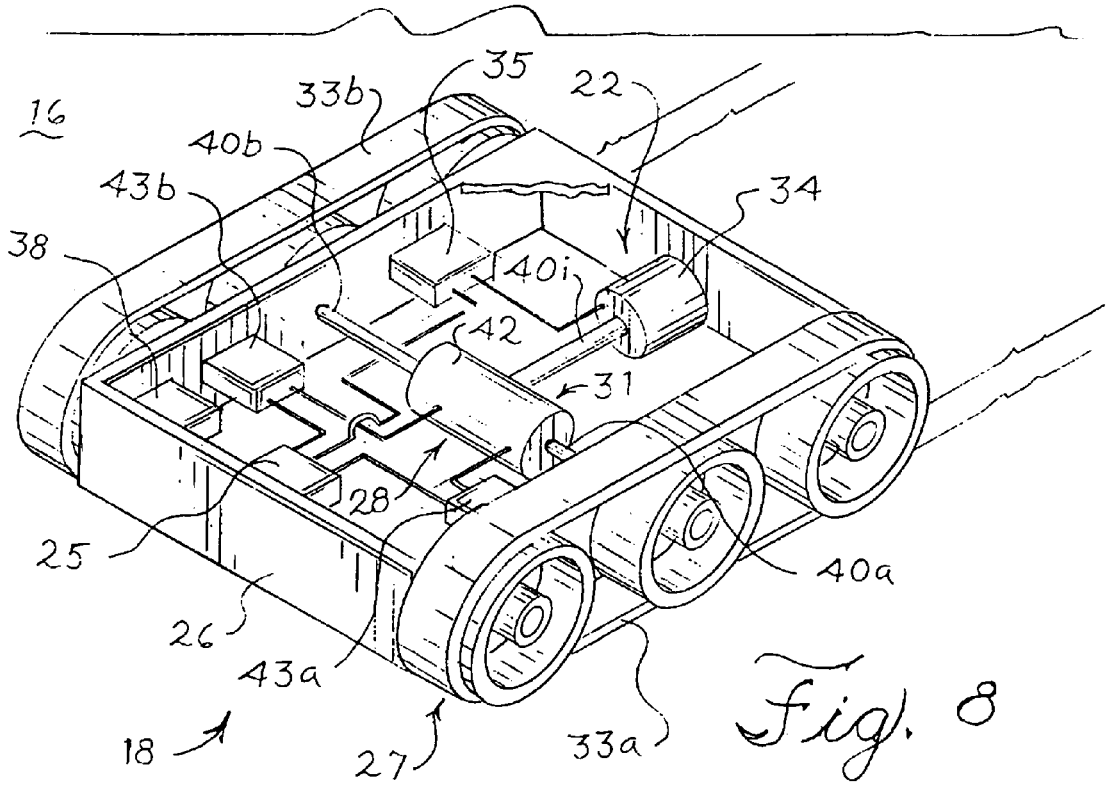
FIG. 8 is a schematic perspective view of an embodiment of the vehicle utilizing a differential steering arrangement having a propulsion means and transmission used in combination with tread assemblies.

In the embodiments of FIGS. 7 and 8, the propulsion means 22, preferably an electric motor 34 with motor control 35 under the influence of the controller 25, provides rotational energy to the transmission 42 via input shaft 40*i*. The transmission 42, also under the influence of the controller 25 via at least one servo mechanism 43 (mechanisms 43*a* and 43*b*), provides rotational energy to the at least two wheels 32*a* and 32*b* or tread assemblies 33*a* and 33*b* via respective shafts 40*a* and 40*b* while varying the rotational speed and direction of at least one wheel or tread assembly via a variation of the rotation of the associated shaft.

Figure 9:
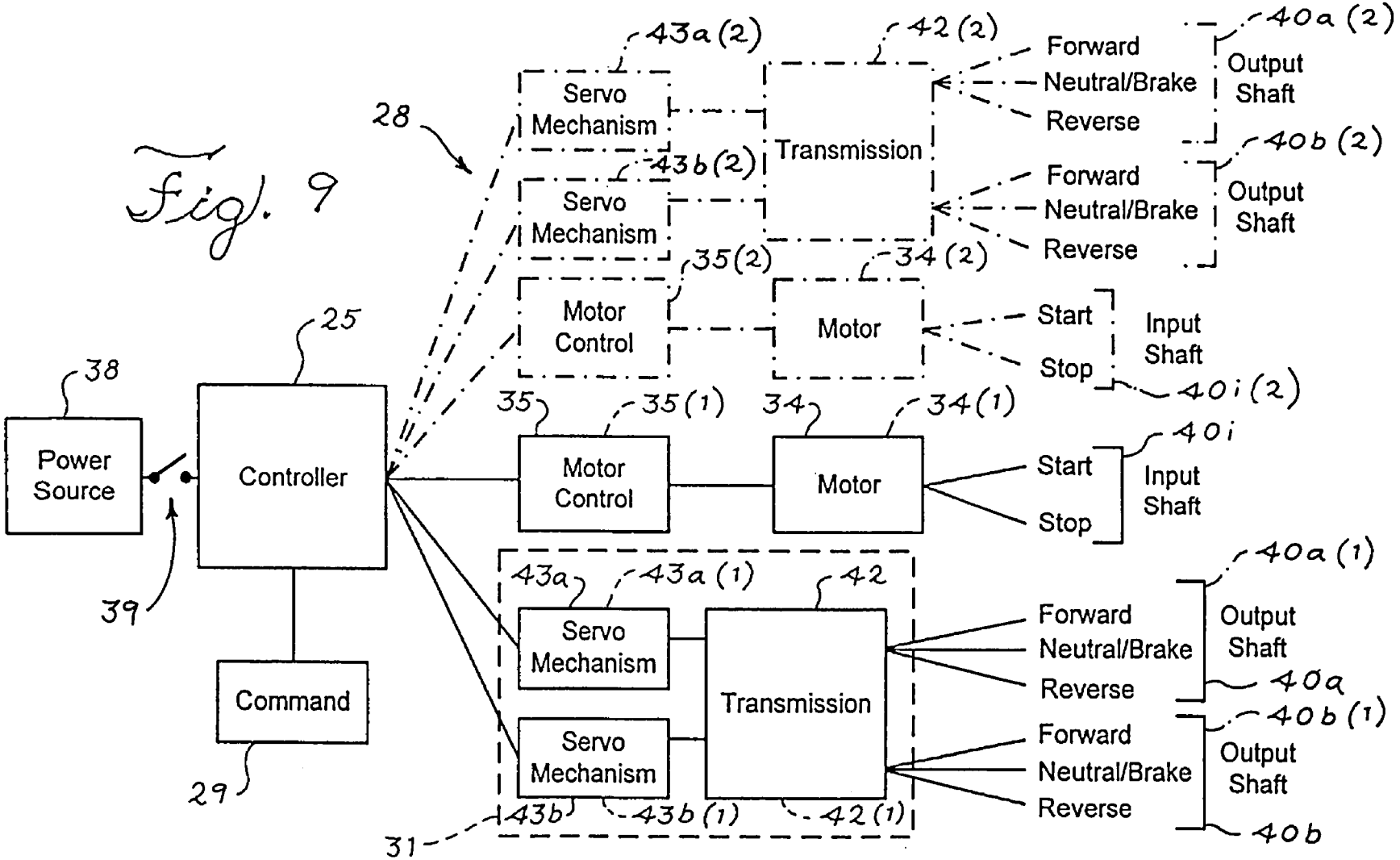
FIG. 9 is a block diagram of an electrical circuit for embodiments of the vehicle utilizing a differential steering arrangement having a transmission as the rotation changer.

FIG. 9 is a block diagram illustrating the basic electric components of the differential steering arrangement 28 wherein the rotation changer 31 comprises at least one differential transmission 42 operably associated with the motor 34 and under the influence of controller 25 via at least one servo mechanism 43. The controller 25, under the influence of command 29, may thus influence the motor 34 via motor control 35 to start or stop imparting rotational energy to the input shaft 40*i* of the transmission 42. The controller may also influence the transmission 42, via at east one servo mechanism 43 (mechanisms 43*a* and 43*b*), to independently start or stop rotation of the respective output shafts 40*a* and 40*b*, increase or decrease their respective speeds of rotation, or to reverse their respective rotational directions. Similar to the embodiment of the vehicle 18 utilizing motors 34 and motor controls 35 as the rotation changer 31, a battery 38, with an on/off switch 39 preferably utilized between the battery and the remaining electrical components, energizes and de-energizes the vehicle accordingly.

Figure 10:
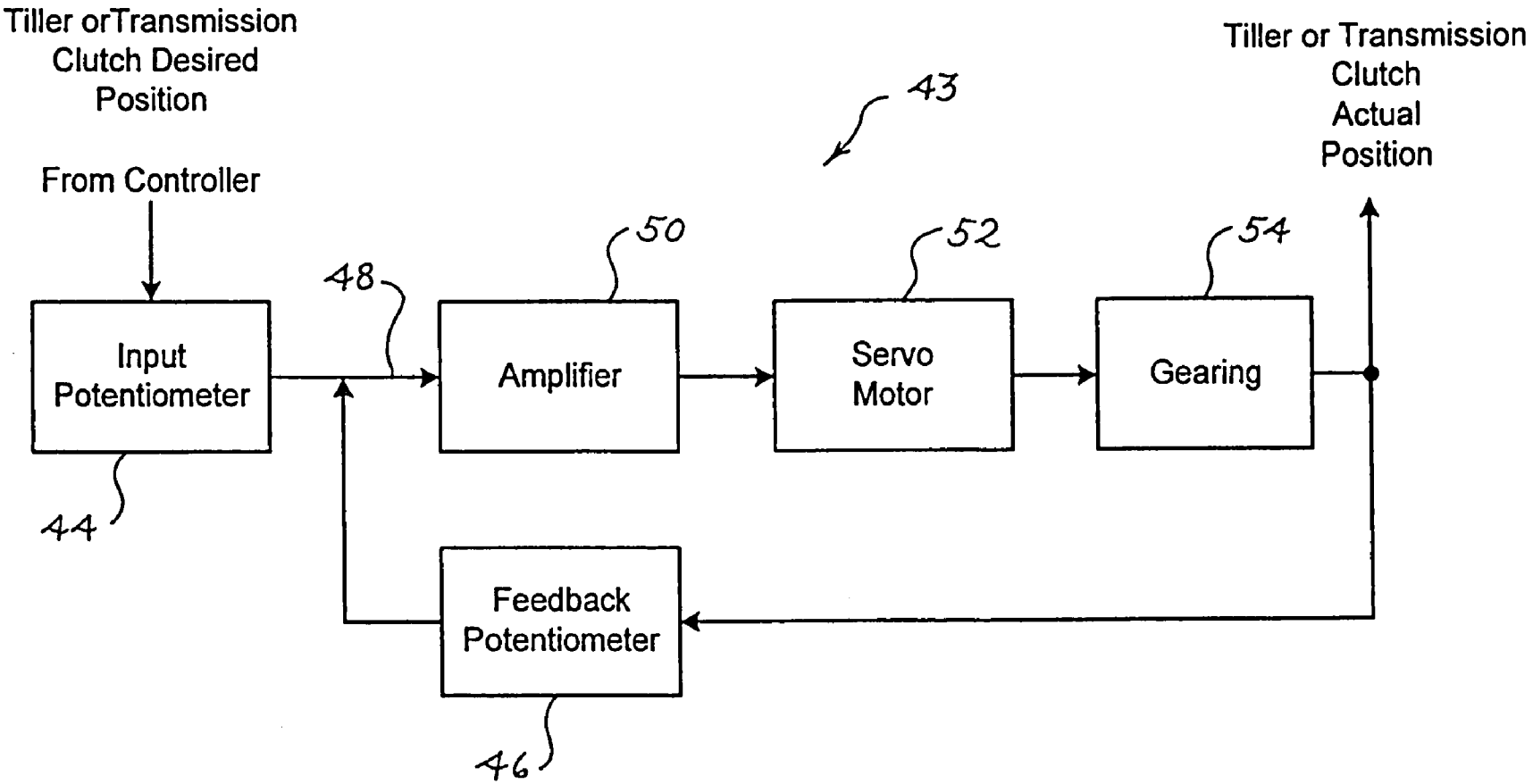
FIG. 10 is a block diagram for a servo mechanism utilized in both the differential and conventional steering arrangements of the invention.

The at least one servo mechanism 43 may comprise any mechanism belonging to the feedback control system group and understood in the art as positioning an object in relation to an input instruction. The operation of such mechanisms, well known in the art, commonly depends on the difference between the actual and desired position of the object. FIG. 10 is a block diagram illustrating an example of the servo mechanism 43. As illustrated therein, input and feedback potentiometers 44 and 46 generate an actuating signal 48 that is amplified by amplifier 50 and sent to a servo motor 52 driving optional gearing 54, with the servo motor thereafter positioning the object (i.e. transmission clutch) in relation to the desired input position and actual feedback position.

As illustrated in FIG. 9, the servo mechanisms 43*a* and 43*b*, under the influence of the controller 25, are connected respectively to bi-directional clutches (not shown) within the transmission 42 to position the clutches in relation to the respective input received from the controller 25. Each bi-directional clutch selectively associates the rotational direction of an output shaft (i.e. shafts 40*a* and 40*b*) of the transmission 42 to the transmission's rotating input shaft 40*i*. Assuming controller 25 influences the motor 34 via motor control 35 to provide rotational energy to the transmission 42 through input shaft 40*i*, a forward movement of a given clutch by a servo mechanism 43*a* or 43*b* engages the associated output shaft 40*a* or 40*b* in a forward rotational direction to the input shaft, resulting in a forward rotation of the associated wheel or tread assembly. A rearward movement of the clutch by the servo mechanism 43*a* or 43*b* engages the associated output shaft 40*a* or 40*b* in a reverse direction to the input shaft 40*i*, resulting in a reverse rotation of the associated wheel or tread assembly. A neutral position of the clutch by the servo mechanism 43*a* or 43*b* disengages the associated output shaft 40*a* or 40*b* from the input shaft 40*i*, thus resulting in transmission of no rotational energy to the associated wheel or tread assembly.

Referring again to FIGS. 7 and 8, if the controller 25 influences the servo mechanisms 43*a* and 43*b* to maintain the bi-directional clutches in a neutral position, the output shafts 40*a* and 40*b* will not rotate, thus imparting no rotational energy on respective wheels 32*a* and 32*b* or tread assemblies 33*a* and 33*b*. Of course, the vehicle 18 will remain stationary when in this state. If the controller 25 influences the servo mechanisms 43*a* and 43*b* to move the associated clutches into a fully forward position, the output shafts 40*a* and 40*b* motors will rotate at the same speed to impart a common rotational speed to respective wheels 32*a* and 32*b* or tread assemblies 33*a* and 33*b*. The vehicle 18 will thus move in a linear direction, assuming that the respective wheels or tread assemblies are of a common size in relation to one another. A full reversal position of the clutches by the servo mechanisms 43*a* and 43*b* will fully reverse the rotational direction of output shafts 40*a* and 40*b*, thus causing the vehicle 18 to travel in a reverse, linear direction.

Conversely, if the controller 25 influences either of servo mechanisms 43*a* and 43*b* to move a clutch to a partially forward or reverse position while the other clutch is in a fully forward position or reverse position, a reduced rotational energy will be transmitted to the associated wheel or tread assembly via the associated output shaft, causing the vehicle 18 to travel in the direction of the slower wheel or assembly. Furthermore, if the controller 25 influences either of servo mechanisms 43*a* or 43*b* move a given clutch into a neutral position to de-energize the associated output shaft while the other clutch motor remains in a forward or reverse position, the wheel or tread assembly associated with the de-energized shaft will stop moving while the other wheel or assembly continues to move, thus causing vehicle 18 to pivot about the stationary wheel or assembly. If the controller 25 influences the servo mechanisms 43*a* and 43*b* to move respective clutches into opposite positions (i.e. one forward, one reverse) to energize respective output shafts 40*a* and 40*b* in opposite directions of rotation, the associated wheels 33*a* and 33*b* or tread assemblies 33*a* and 33*b* will rotate in opposite directions, thus causing the vehicle 18 to rotate in place.

Figure 11:
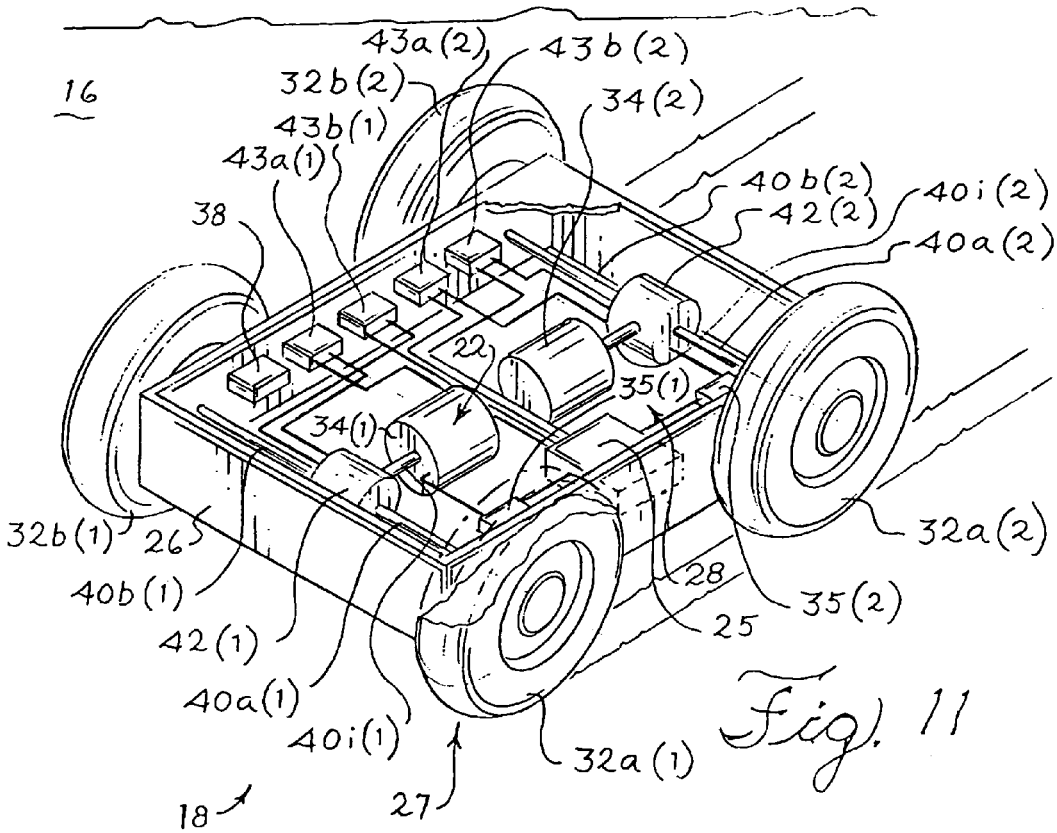
FIG. 11 is a schematic perspective view of another embodiment of the vehicle utilizing a differential steering arrangement, but having additional propulsion means and transmissions used in combination with wheels.
Figure 12:
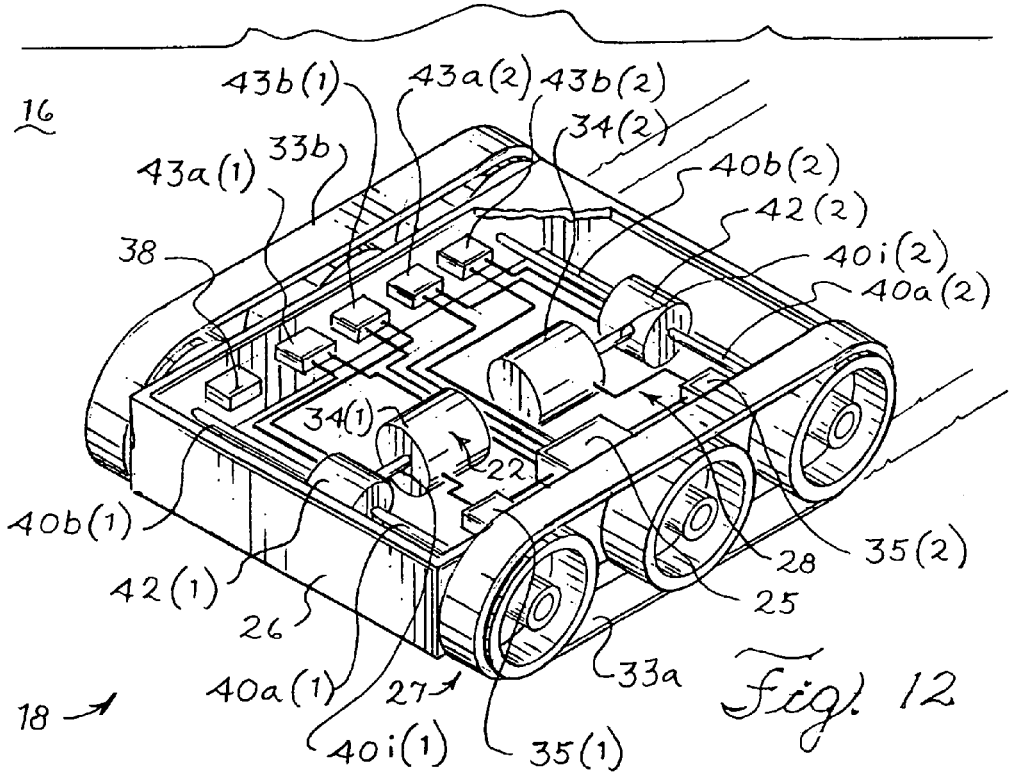
FIG. 12 is a schematic perspective view of another embodiment of the vehicle utilizing a differential steering arrangement, but having additional propulsion means and transmissions used in combination with tread assemblies.

While FIG. 7 illustrates a vehicle 18 having two wheels 32*a* and 32*b* associated with the transmission 42, it is understood that third, fourth or any number wheels and associated transmissions may be located on the chassis 26 as well. Similarly, while FIG. 8 illustrates a vehicle 18 having each tread assembly 33*a* and 33*b* associated with a respective single transmission 42, it is understood that any number of transmissions may be associated with a given tread assembly as well. FIG. 11 thus illustrates a vehicle 18 having four wheels 32*a*(1), 32*a*(2), 32*b*(1) and 32*b*(2) with two associated transmissions 42(1) and 42(2) while FIG. 12 illustrates a vehicle 18 having two tread assemblies 33*a* and 33*b* associated with the same two transmissions.

Similar to the embodiments of FIGS. 7 and 8, the transmissions 42(1) and 42(2) are connected to the respective wheels via respectively paired output shafts 40*a*(1), 40*b*(1) and 40*a*(2), 40*b*(2). Each transmission 42(1) and 42(2) receives input energy from respective motors 34(1) and 34(2) via respective input shafts 40*i*(1) and 40*i*(2). The motors 34(1) and 34(2) are influenced by controller 25 via respective motor controls 35(1) and 35(2). Although two motors 34(1) and 34(2) are utilized within these figure (i.e. one per transmission), it is understood that both transmissions 42(1) and 42(2) can derive their input energy from a single motor as well.

The respective output shafts of the transmissions may respectively undergo variations in speed and direction via at least one servo mechanism under the influence of the controller. Thus, as illustrated in FIGS. 11 and 12, a pair of servo mechanisms 43*a*(1) and 43*b*(1) is associated with transmission 42(1) while a second pair of servo mechanisms 43*a*(2) and 43*b*(2) is associated transmission 42(2). Servo mechanisms 43*a*(1) and 43*a*(2) receive common input from the controller 25, as do servo mechanisms 43*b*(1) and 43*b*(2), to ensure that that the output shafts located on a common side of the vehicle 18 (i.e. 40*a*(1), 40*a*(2) and 40*b*(1) and 40*b*(2), respectively) have a common rotational speed and direction. Such a commonality of speed and direction for the output shafts located on a common side of the vehicle ensures that a common speed and direction of the associated wheels or tread assemblies occurs, thus ensuring a proper direction of the vehicle 18.

The operation of the of the servo mechanisms in relation to the clutches of the respective transmissions within these figures is thus similar to those illustrated in FIGS. 7 and 8, with both servo mechanisms per common side of the vehicle (i.e. 43*a*(1), 43*a*(2) and 43*b*(1), 43*b*(2), respectively) receiving the same operational input from the controller. Thus, referring again to FIG. 9, the additional motor and motor control, 34(2) and 35(2) and additional transmission and servo mechanisms, 42(2) and 43*a*(2), 43*b*(2) are illustrated within the block diagram in phantom, with motor and motor control 34 and 35 and transmission and servo mechanisms 42 and 43*a*, 43*b*, denoted in phantom as 34(1) and 35(1) and 42(1) and 43*a*(1), 43*b*(1), respectively, to differentiate them from the additional components.

Although electric motors are preferably used as the propulsion means 22 in the above-described embodiments, it is understood that the propulsion means may also comprise one or more an internal combustion engines or any other device understood in the art as converting potential to kinetic energy. If an internal combustion engine is utilized, one or more servo mechanisms 43, as described above, may be connected to the engine's throttle control to receive commands from the controller 25 for energization or de-energization of the engine.

Figure 13:
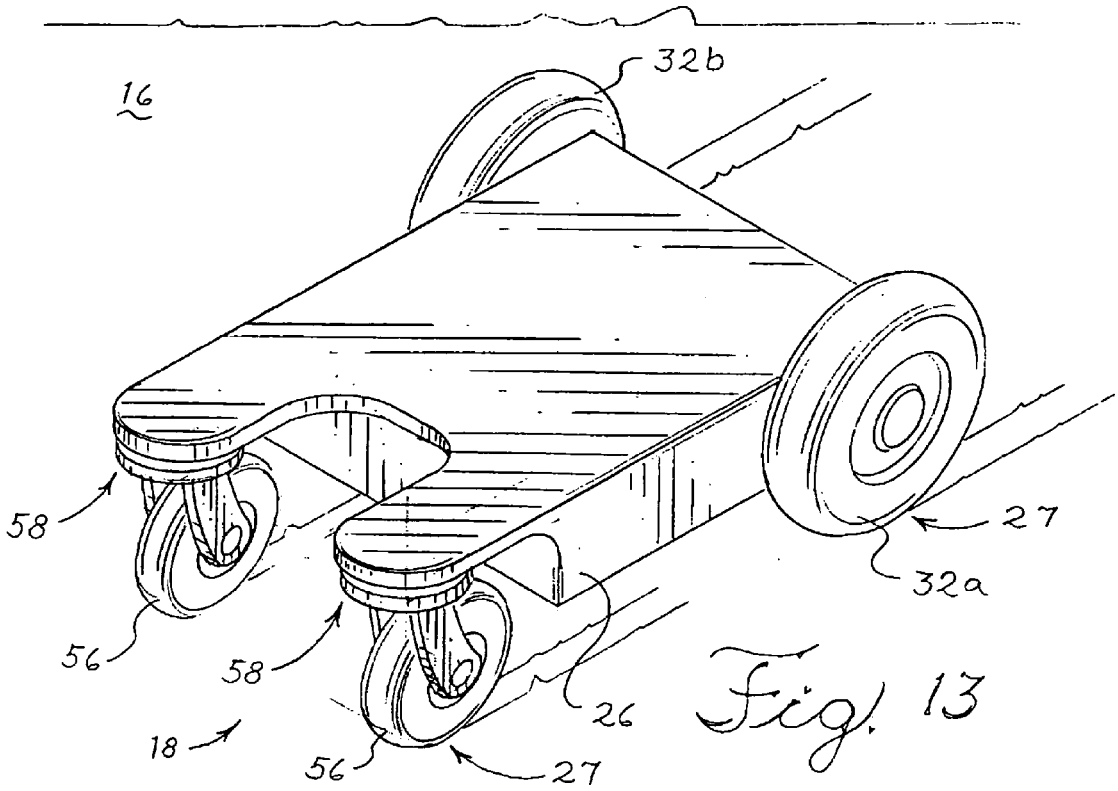
FIG. 13 is a schematic perspective view of an embodiment of the vehicle utilizing non-driven wheels located at a common end of the chassis.

Also, in addition to the one or more wheels or tread assemblies comprising the supports 27 driven by propulsion means 22, non-driven supports may also be utilized to provide additional support to vehicle 18 as well. Such non-driven supports may include one or more skids or wheels associated with the chassis 26. The one or more skids or wheels are supported by and, in turn, support the chassis 26. For example, FIGS. 13 and 14 each illustrate embodiments of the vehicle having at least one non-driven wheel 56 associated with the chassis 26 via freely rotating casters 58 to allow the wheels to pivot in the direction of the vehicle 18. FIG. 13 illustrates non-driven wheels 56 and associated casters 58 located at a common end of the chassis 26 while FIG. 14 illustrates the non-driven wheels 56 and associated casters 58 located at opposite ends of the chassis 26.

Figure 14:
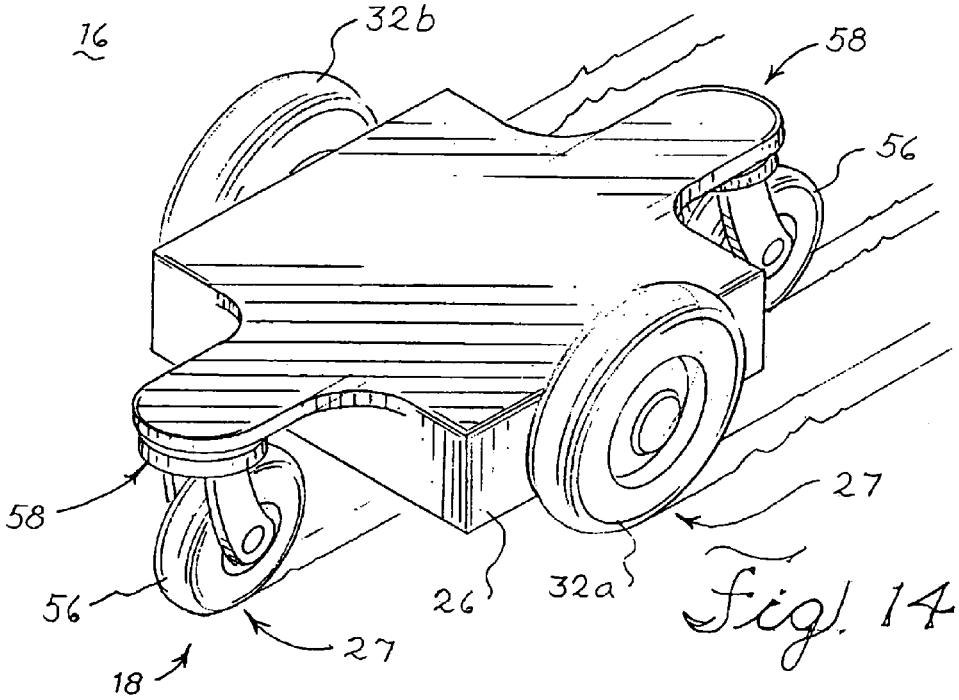
FIG. 14 is a schematic perspective view of an embodiment of the vehicle utilizing non-driven wheels located at opposite ends of the chassis.

It is understood that the embodiments of FIGS. 13 and 14 may utilize the propulsion means 22 and rotation changers 31 previously described herein to drive the wheels 32*a* and 32*b*, to include the respective motors and controls 34 and 35 illustrated in FIGS. 2, 3, 5 and 6 or the propulsion means 22 and transmissions 42 illustrated in FIGS. 7, 8, 11 and 12. It is also understood that tread assemblies 33*a* and 33*b* may be used in place of the wheels 32*a* and 32*b* illustrated in the embodiments of FIGS. 13 and 14 as well. Also, while FIGS. 13 and 14 illustrate embodiments of the vehicle 18 having non-driven wheels 56 located at common and opposite ends of the chassis, respectively, it is understood that the at least one non-driven wheel 56 and associated casters 58 may be located anywhere in relation to the chassis 26 to provide support to the vehicle 18.

It is further understood that both fewer or additional wheels 56 and associated casters 58 than those illustrated in FIGS. 13 and 14 may be utilized in further embodiments of the invention as well. For example, only one non-driven wheel 56 with caster 58 may be utilized with a pair of wheels 32*a* and 32*b* of the embodiment illustrated in FIG. 14 to comprise a vehicle 18 having three total wheels. Furthermore, it is understood that skids may be used in place of any of the non-driven wheels in the embodiments illustrated in FIGS. 13 and 14.

Figure 17:
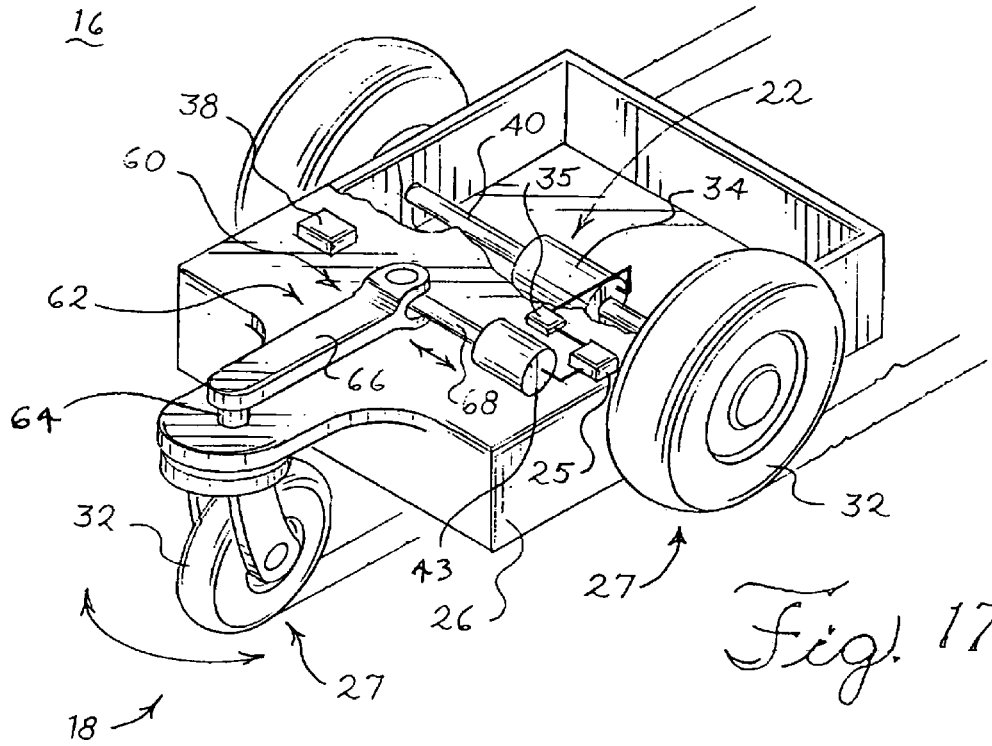
FIG. 17 is a schematic perspective view of an embodiment of the vehicle utilizing a conventional steering arrangement having at least one wheel associated with the propulsion means and a different wheel associated with the direction changer.
Figure 18:
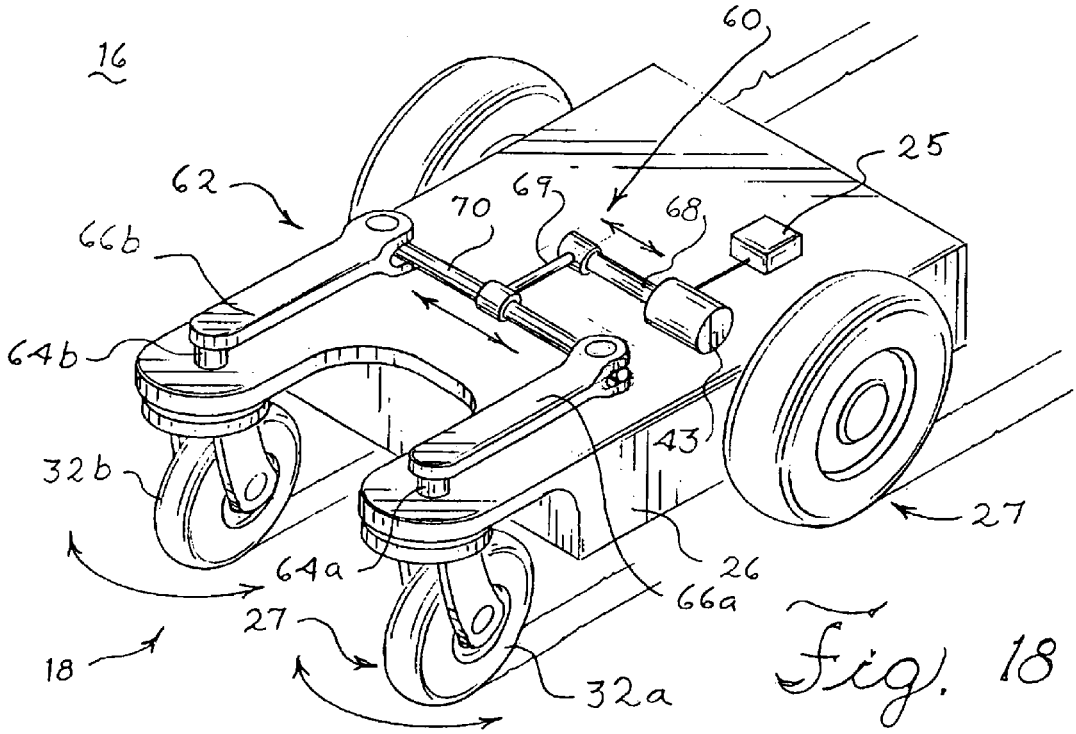
FIG. 18 is a schematic perspective view of an embodiment of the vehicle having additional wheels associated with the conventional steering arrangement.

FIGS. 15, 17 and 18 illustrate embodiments of the vehicle 18 utilizing the conventional steering arrangement 60. Again, for the sake of clarity, neither the target assembly 12 nor the connector 20 is illustrated within these figures. Within each of the figures, the vehicle 18 comprises a chassis 26 having a plurality of supports 27 movably associated therewith and in communication with the surface 16. The supports 27 are again supported by and, in turn, support the chassis 26. The conventional steering arrangement 60 and propulsion means 22 are preferably also supported by the chassis 26, with the steering arrangement comprising a direction changer 62. The direction changer 62 and the propulsion means 22 are under the influence of the controller 25, with the direction changer operable to adjust the angular orientation of at least one support 27 in relation to the chassis 26 to effect a change in direction of the vehicle 18.

The direction changer 62 changes the angular orientation of at least one support 27 (i.e. wheel) in relation to the chassis 26 to steer or change the direction of the vehicle 18. For example, simple tiller-type systems, rack-and-pinion configurations, pitman arm assemblies, recirculating ball systems, or other steering configurations commonly known in the art may be utilized as the direction changer 62 to change the direction of the vehicle 18.

Utilizing a tiller-type steering system, the direction changer 62 comprises at least one pin 64 rotatably connected to the chassis 26 and having at least one support 27 and a tiller 66 connected thereto. The tiller 66 for the at least one pin 64 is operably associated via rod 68 with a servo-mechanism 43 preferably having the same components illustrated in FIG. 10. The servo-mechanism 43 is under the influence of the controller 25 to induce a rotational movement of the pin 64 in relation to the chassis 26. Such a rotation thus adjusts the angular orientation of the at least one support 27 in relation to the chassis 26 to effect a change in direction of the vehicle 18.

FIG. 15 illustrates an embodiment having at least one support 27 operably associated with the propulsion means 22 and direction changer 62 of the vehicle 18. The wheel 32, driven by the motor 34 under the influence of the controller 25 via the motor control 35, is connected to an end of the chassis 26 by the pin 64. The wheel 32 is rotatably connected to one end of the pin 64 while the pin is rotatably connected to the chassis 26. The tiller 66 extends from an opposite end of the pin 64 and is operably associated with the servo mechanism 43 via the rod 68. The servo mechanism 43, when actuated, induces an axial movement of the rod 68 in relation to the chassis 26. The axial movement of the rod 68 against the tiller 66 causes a rotational movement of the pin 64, changing the angular orientation of the wheel 32 in relation to chassis 26 to direct the vehicle 18.

Referring again to FIG. 15, motor 34, preferably mounted to pin 64, is connected to wheel 32 via shaft 40 and is under the influence of the controller 25 via at least one motor control 35. Thus, when energized by the battery 38 (again illustrated in the figures with the wires omitted for clarity), motor 34 rotates shaft 40 to impart a rotational motion on the wheel 32 of the vehicle 18, thereby propelling the vehicle across the surface. While, for the sake of example, FIG. 15 illustrates the motor 34 connected to wheel 32 via shaft 40, it is understood that the motor may be connected to the wheel via various other energy transfer arrangements well known in the art, to include gears, belts, chain drives, or various combinations thereof. Such other energy transfer arrangements may be utilized to increase or decrease the rotational speed of the wheel in relation to that of the motor.

Figure 16:
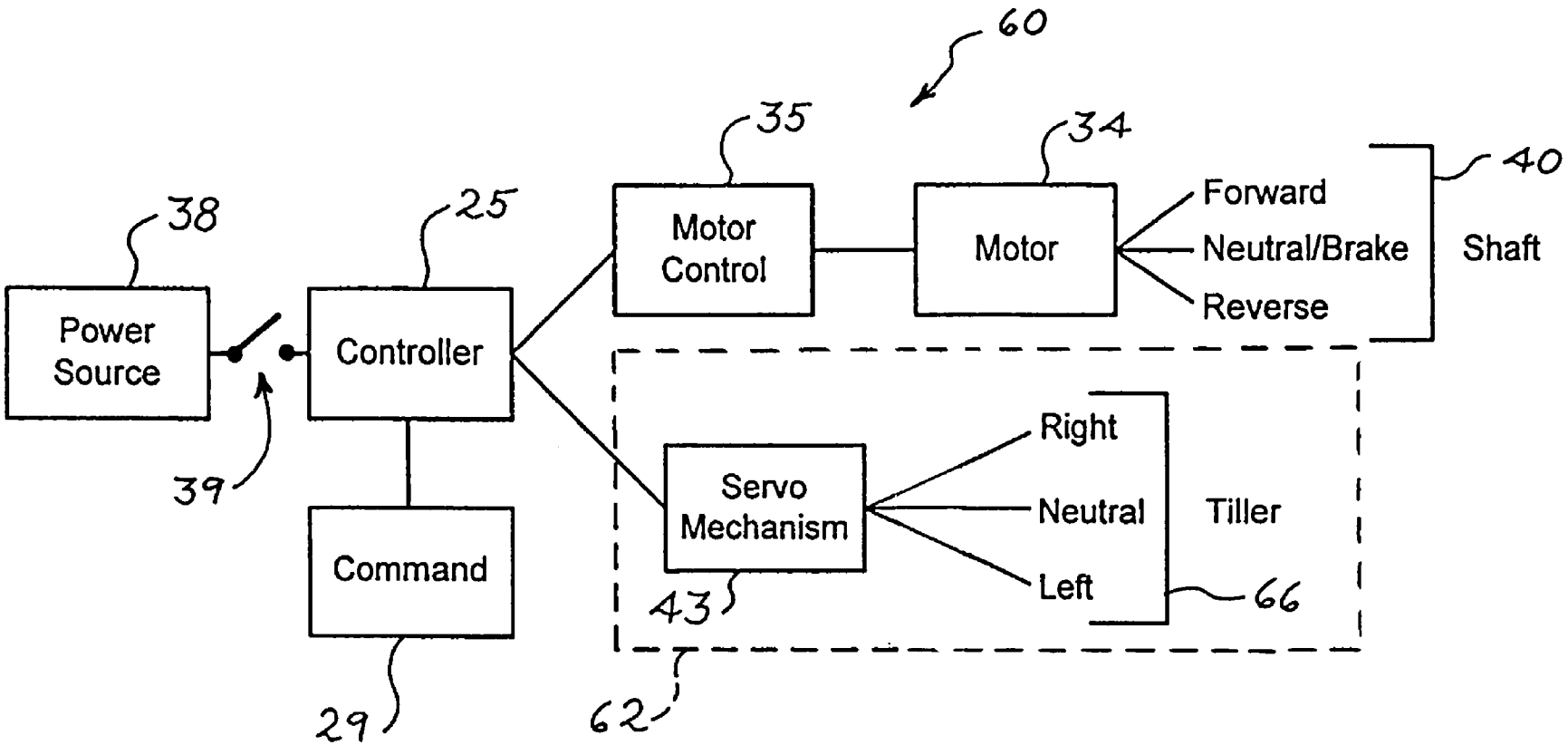
FIG. 16 is a block diagram of an electrical circuit for embodiments of the vehicle utilizing a conventional steering arrangement.

FIG. 16 is a block diagram illustrating the basic electrical components of the conventional steering arrangement 60 wherein the direction changer 62 comprises the tiller and pin operably associated with the at least one servo mechanism 43 under the influence of the controller 25. The at least one motor control 35 is also under the influence of the controller 25. The controller receives instructions from the command 29. Under the influence of the at least one motor control 35, the rotational speed and direction of the motor 34 is thus variable to impart a predetermined rotational speed and direction on the wheel 32 via shaft 40. The motor control 35 may thus cause the motor 34 to start or stop rotation, to increase or decrease its speeds of rotation, or to reverse rotational direction, thus imparting the instructed movement on the associated wheel. Similar to the embodiments of the vehicle 18 utilizing a differential steering arrangement 28, a battery 38, with an on/off switch 39 preferably utilized between the battery and the remaining electrical components, energizes and de-energizes the vehicle accordingly.

If the controller 25 influences the motor control 35 to de-energize the motor 34, the motor will not rotate, thus imparting no rotational energy on wheel 32. Of course, the vehicle 18 will remain stationary when in this state. If the controller 25 influences the motor control 35 to energize the motor 34 with a predetermined level of electrical current, the motor will rotate to impart a rotational speed to wheel 32, thus moving the vehicle. A reversal of the motor's rotational speed will cause the vehicle 18 to travel in a reverse direction. With the motor 34 rotating the wheel 32 in a given direction, the controller 25 influences the servo mechanism 43 to axially move the rod 68 against the tiller 66, resulting in a rotational movement of the pin 64 in relation to the chassis 26. Such a rotation thus adjusts the angular orientation of the wheel 32 in relation to the chassis 26, thus causing the vehicle to turn in the direction of the pin's rotation.

In addition to having at least one support associated with the propulsion means and direction changer 62 as shown in FIG. 15, a further embodiment may have at least one support 27 operably associated with the propulsion means 22, with at least one support operably associated with the direction changer and not with the propulsion means, as illustrated in FIG. 17. The direction changer 62 is thus operable to adjust the angular orientation of the associated at least one support 27 (i.e. wheel 32) in relation to the chassis 26 to effect a change in direction of the vehicle 18, while the propulsion means (i.e. motor 34), via shaft 40, drives at least one support (wheel) not associated with the direction changer. Although the motor 34 and motor control 35 of the embodiment illustrated in FIG. 17 are associated with a wheel 32 of the vehicle 18 not acted on by tiller 66, the operation of these components are nonetheless similar to those illustrated in FIG. 15 to move and direct the vehicle accordingly.

While only one wheel is illustrated within FIGS. 15 and 17 as steerable by direction changer 62, it is understood that additional wheels may added to the chassis 26 that are steerable as well. For example, as illustrated in FIG. 18, wheels 32*a* and 32*b* are respectively connected to an end of the chassis 26 by pins 64*a* and 64*b*. The wheels 32*a* and 32*b* are rotatably connected to one end of the pins 64*a* and 64*b* while the pins are rotatably connected to the chassis 26. Tillers 66*a* and 66*b* respectively extend from an opposite end of the pins 64*a* and 64*b* and are movably connected via rods 68, 69 and 70 to servo mechanism 43. When servo mechanism 43, under the influence of the controller 25, is actuated, it induces an axial movement of the rod 68 in relation to the chassis 26. The axial movement of the rod 68 to move the tillers 66*a* and 66*b* causes a rotational movement of the pins 64*a* and 64*b*, changing the angular orientation of the wheels 32*a* and 32*b* in relation to chassis 26 to direct the vehicle 18.

In the preferred embodiment of the invention, the propulsion means of the embodiment shown in FIGS. 15, 17 and 18 preferably comprise one or more electric motors 34 and associated controls 35. However, it is understood that an internal combustion engine may be used in place of the motor, as well as any other energy-producing device understood in the art. Again, if an internal combustion engine is utilized, one or more servo mechanisms 43, as described above, may be connected to the engine's throttle control to receive commands from the controller 25 for energization or de-energization of the engine.

In the foregoing embodiments of the invention, the controller 25 utilizes conventional microprocessor-based electronics understood in the art to receive instructions from the command 29 and transmit them to the propulsion and steering means 22 and 24. The received instructions influence to the propulsion and steering means of the vehicle to control the vehicle's starting and stopping movements as well as the vehicle's speed and direction.

Figure 19:
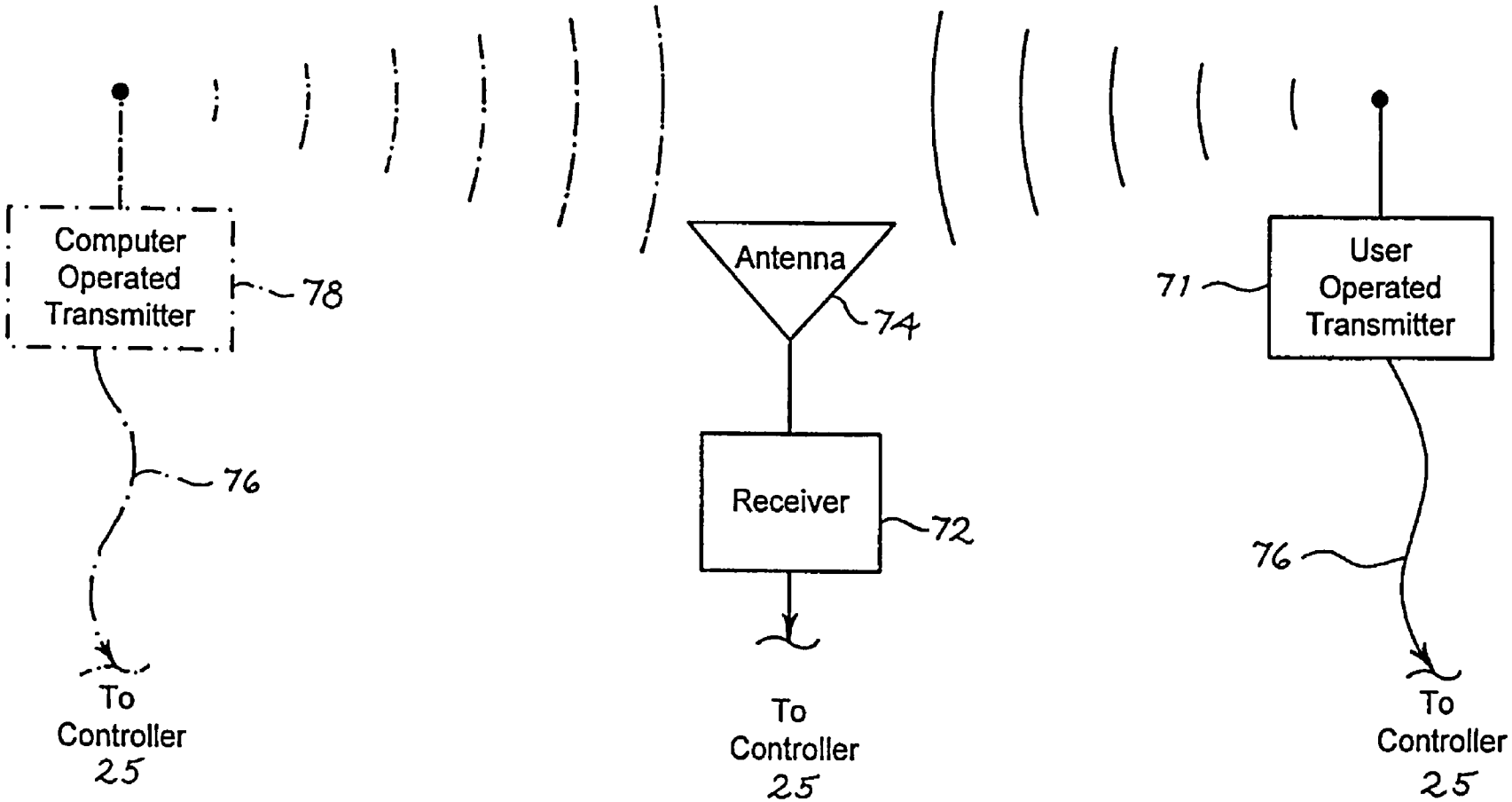
FIG. 19 is a block diagram of an electrical circuit illustrating various embodiments of the command.
Figure 22:
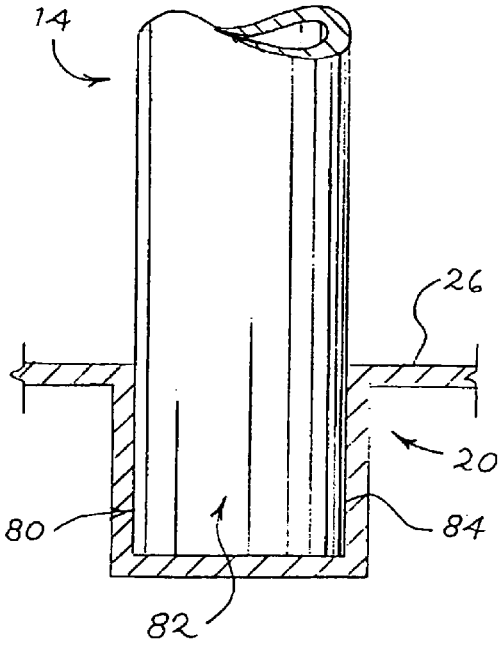
FIG. 22 is a sectional view of the connector of FIG. 1 in sliding engagement with the stand of the target assembly.

In one embodiment of the invention, as illustrated in FIG. 19, the command 29 comprises a remote, wireless, user-operated transmitter 71 for communication with receiver 72 associated with the controller 25. The receiver 72 thus includes an antenna 74 to receive radio signals sent by the transmitter 71 for instructing the speed and direction of the vehicle. The components of the wireless, user-operated transmitter and receiver are well known in the art and are routinely used hobbyists and the like for controlling model airplanes, boats and cars. While a wireless transmitter is utilized in the preferred embodiment of the invention, it is understood that a hard-wire cable (i.e. a tether 76) having a pre-determined length may connect the transmitter to the controller for transmitting instructions to the vehicle as well.

Regardless of whether a wireless or tethered user-operated transmitter is used, user-operated transmitter 71 of the preferred embodiment utilizes at least two channels of communication with the controller 25 to instruct the vehicle's speed and direction. Each of the at least two channels of communication is associated with one of at least two controls (i.e. control sticks, wheels or switches or other similar means known in the art) located on the user-operated transmitter. Each control is manipulated or moved between forward, rearward, neutral and left and right positions to create instructions for transmission to the controller over the associated channel.

FIG. 20 is a table setting forth the various control positions of a user-operated transmitter 71 for operation of embodiments of the invention utilizing a differential steering arrangement 28. Preferably, left and right controls of the user-operated transmitter 71 are respectively associated with the motors, motor controls and supports (i.e. wheels or tread assemblies) located on a common left and right side of the vehicle such that the movement of each side of the vehicle is controlled independent of one another. As illustrated in FIG. 20, an operator of the user-operated transmitter moves the vehicle in a forward motion by moving both controls to a forward position, designated F-F. A rearward position of both controls, designated R-R, moves the vehicle in a reverse direction. A movement of both controls into the neutral position, designated N-N, causes the vehicle to stop and/or remain in a fixed location. A partially forward or partially rearward movement of both controls, respectively designated NF-NF or NR-NR, causes the vehicle to move in a forward or reverse direction at a reduced speed.

If the operator moves one control gradually forward or rearward of the other control, the vehicle makes a turn. For example, a movement of the one control to a fully forward position and the other control to a partially forward position, designated F-NF, will result in the vehicle making a forward right turn. A movement of one control fully forward and the other control fully rearward, designated F-R, causes the vehicle to rotate in place in a clockwise direction. A movement of one control fully or partially forward or rearward while the other control is neutral, designated F-N, R-N, or NF-N, NR-N, respectively, will cause the vehicle to pivot in a forward or reverse direction about its neutral right support at various speeds. As illustrated in FIG. 20, multiple other combinations of control positions are used to execute a multitude of movements with the vehicle, i.e. NF-F, R-NR, NR-R, R-F, N-F, N-R, N-NF and N-NR, to execute a forward left turn, reverse right turn, reverse left turn, counterclockwise rotation, and forward and reverse pivots about its neutral left support at various speeds, respectively FIG. 21 is a table setting forth the various control positions of a user-operated transmitter 71 for operation of embodiments of the invention utilizing a conventional steering arrangement 60. Preferably, one control of the user-operated transmitter 71 (i.e. the left control) is associated with the rotational speed and direction of the propulsion means while the other control of the transmitter (i.e. the right control) is associated with the direction changer. As illustrated in FIG. 21, to move the vehicle in a straight-line forward or reverse direction, an operator of the user-operated transmitter moves the left control to a forward or rearward position while maintaining the right control in a neutral position, designated F-N and R-N, respectively. A movement of the left control into the neutral position, designated N, causes the vehicle to stop and/or remain in a fixed location regardless of the position of the right control. A partially forward or partially rearward movement of the left control while maintaining the right control in a neutral position, designated NF-N or NR-N, respectively, will cause the vehicle to move in a straight-line forward or reverse direction at a reduced speed.

A movement of the left control to a forward or rearward position and the right control to a right position, designated F-Rt or R-Rt, causes the propulsion means to rotate in a forward or reverse direction while the rotation changer rotates in a right-handed or clockwise direction, thus resulting in the vehicle making a forward or reverse right turn. Likewise, a movement of the left control to a forward or rearward position and the right control to a left position, designated F-Lt or R-Lt, causes the propulsion means to rotate in a forward or reverse direction while the rotation changer rotates in a left-handed or counter-clockwise direction, thus resulting in the vehicle making a forward or reverse left turn, respectively. As illustrated in FIG. 21, a movement of the left control to a partially forward or rearward position while moving the right control to a right or left position, designated NF-Rt, NF-Lt, NR-Rt, and NR-Lt, respectively, will cause the propulsion means to rotate in a forward or reverse direction at a reduced speed while the rotation changer rotates in a right or left-handed direction, resulting in the vehicle executing forward or reverse right or left turns at a reduced speed.

In another embodiment of the invention, the command 29 comprises a programmable computer-operated transmitter 78 for creating instructions for transmission to the controller 25 to move and direct the mobile target to, from and/or between a plurality of desired target locations. The computer-operated transmitter 78 may be located on-board the vehicle itself or located remotely of the vehicle, as illustrated in phantom in FIG. 19, with a single computer-operated transmitter instructing or commanding one, two, or any number of mobile disc golf targets. As illustrated in FIG. 19, the transmission of instructions from the computer-operated transmitter 78 to the controller 25 may occur through wireless communication via the receiver 72 and antenna 74 or via hard-wired communication through tether 76.

In the preferred embodiment of the invention, the computer-operated transmitter 78 receives one or more programs that are executed to create the instructions for the command 25 of the vehicle 18. The one or more programs include the desired locations for a given mobile target on the playing course (i.e. mapping out a playing course), with the execution of the program creating the instructions to move and direct the one or more mobile targets from one predetermined location to the next.

The locations programmed into the computer may be "custom" determined by the disc-golf participant, mobile target owner, or other when, for example, creating a desired playing, practice or tournament course within a given area. Such locations, of course, may be changed to allow for a change in the layout of a given course. The mobile target locations programmed into the computer may also be "predetermined" to recreate or emulate an already existing playing, practice or tournament course. For example, the locations programmed into the computer may be set to recreate a given tournament playing course such that the participant or other can recreate the same course in any geographical location to practice for the respective tournament.

The computer may be programmed by the participant, mobile target owner or other, or pre-programmed by the target's manufacturer, retail seller or other to establish the target's locations and/or a given playing course. The locations and or playing courses may also be pre-programmed by third-party providers and transferred to a given computer via wireless or wired data transmission (i.e. from another computer or from the internet) or via any transferable media understood in the art, to include CD or DVD roms, floppy discs, memory cards or cartridges, etc.

The computer may guide one or more mobile targets to the various programmed locations via a point-to-point coordinate utilizing angles and distances existing between given locations, or via satellite navigation systems understood in the art. The antenna 74 of the receiver 72 may thus receive global positioning system ("GPS") signals from one or more GPS satellites that circle the earth and permit earth-base receivers to triangulate the longitude and latitude of a given mobile disc target.

With regard to a connection of the target assembly 12 to the vehicle 18, in the preferred embodiment of the invention, the target assembly is removably connected to the vehicle at connector 20. FIGS. 22-31 thus illustrate various embodiments of the connector 20. Although the embodiments of connector 20 illustrated within these figures show the connector located on the chassis 26, the connector of each of these embodiments may be located on the cover 30 of the vehicle 18 as well, as illustrated in phantom in FIG. 1.

Figure 27:
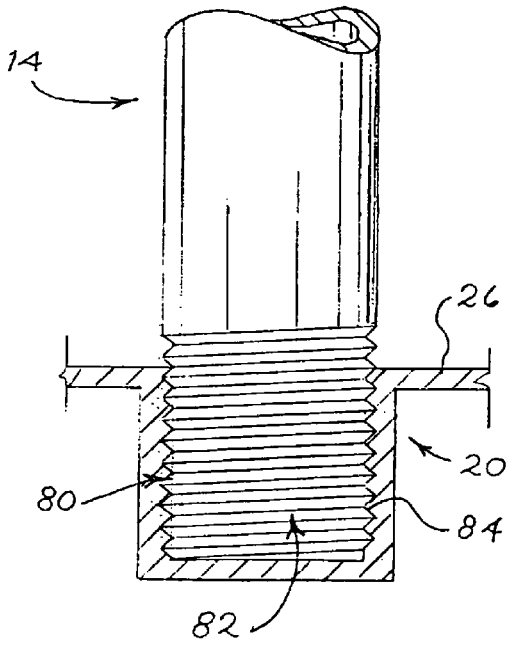
FIG. 27 is a sectional view of the connector of FIG. 1 in threaded engagement with the stand of the target assembly.

FIGS. 22-27 are sectional views from FIG. 1 illustrating embodiments of the connector 20 comprising a void 80 defined in the chassis 26 and adapted to accept an insertion of a lower end 82 of the stand 14 therein. In the embodiments illustrated within these figures, the void 80 defines an inner wall 84 configured to accept an insertion of the lower end 82 of the stand 14 therein. The stand 14 may be secured within the connector 20 via a resistance fit between the two (FIG. 22), via set screw 86 (FIG. 23), via biased pin 88 (FIG. 24), via key 90 (FIG. 25), compression nut 92 (FIG. 26), or via internal threaded engagement (FIG. 27). Each of the connectors 20 illustrated within these figures is well known in the art.

Figure 28:
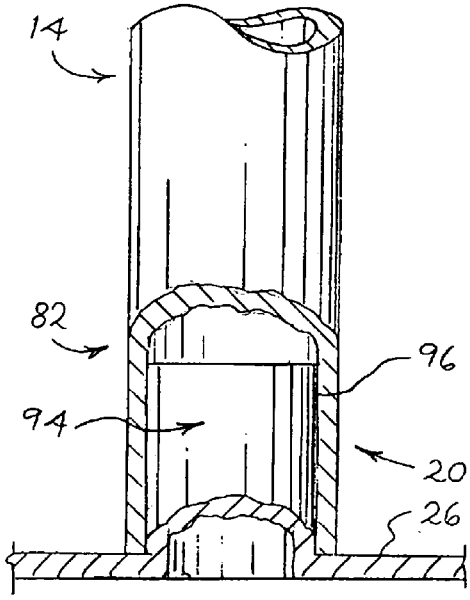
FIG. 28 is a sectional view of an embodiment of the connector of FIG. 1 having a protuberance in sliding engagement with the stand of the target assembly.
Figure 29:
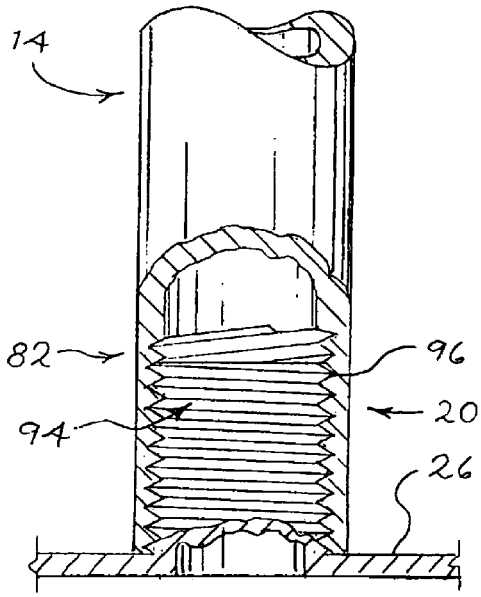
FIG. 29 is a sectional view of an embodiment of the connector of FIG. 1 having a protuberance in treaded engagement with the stand of the target assembly.
Figure 23:
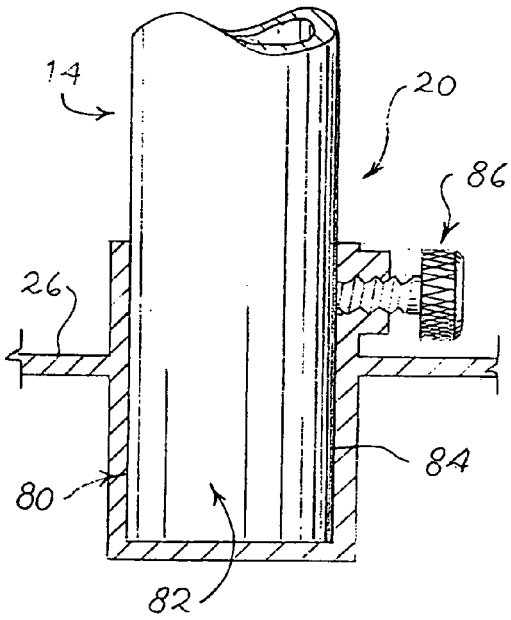
FIG. 23 is a sectional view of the connector of FIG. 1 in sliding engagement with the stand of the target assembly and utilizing a set-screw to secure the stand.
Figure 26:
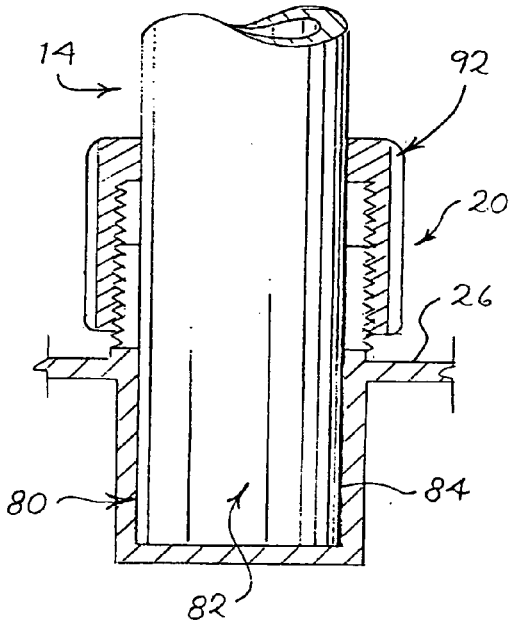
FIG. 26 is a sectional view of the connector of FIG. 1 in sliding engagement with the stand of the target assembly and utilizing a compression nut to secure the stand.
Figure 24:
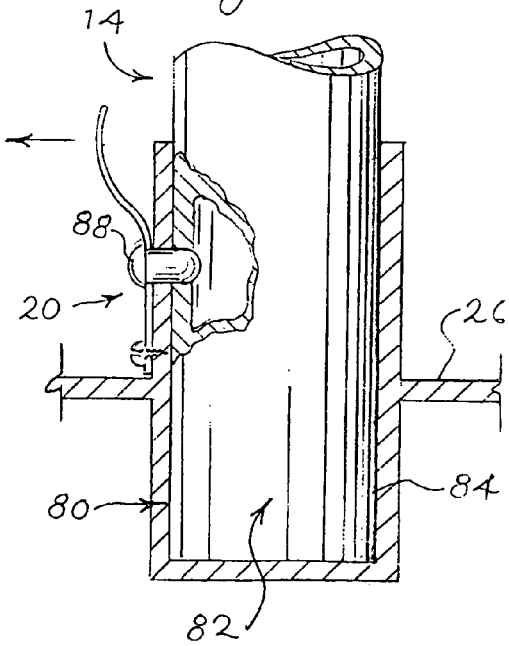
FIG. 24 is a sectional view of the connector of FIG. 1 in sliding engagement with the stand of the target assembly and utilizing a biased pin to secure the stand.
Figure 25:
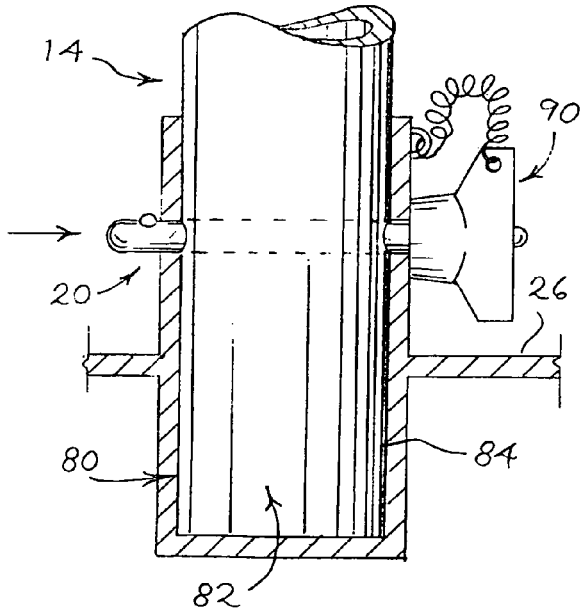
FIG. 25 is a sectional view of the connector of FIG. 1 in sliding engagement with the stand of the target assembly and utilizing a key to secure the stand.

FIGS. 28 and 29 are sectional views from FIG. 1 illustrating embodiments of the connector 20 comprising a protuberance 94 defined on the chassis 26 and adapted for insertion into the lower end 82 of stand 14. In the embodiment illustrated in FIG. 28, the protuberance 94 defines an outer wall 96 adapted for sliding insertion into the lower end 82 of the stand 14. The protuberance 94 is preferably secured within stand 14 via a resistance fit between the two (FIG. 28) or via internal threaded engagement (FIG. 29).

Figure 31:
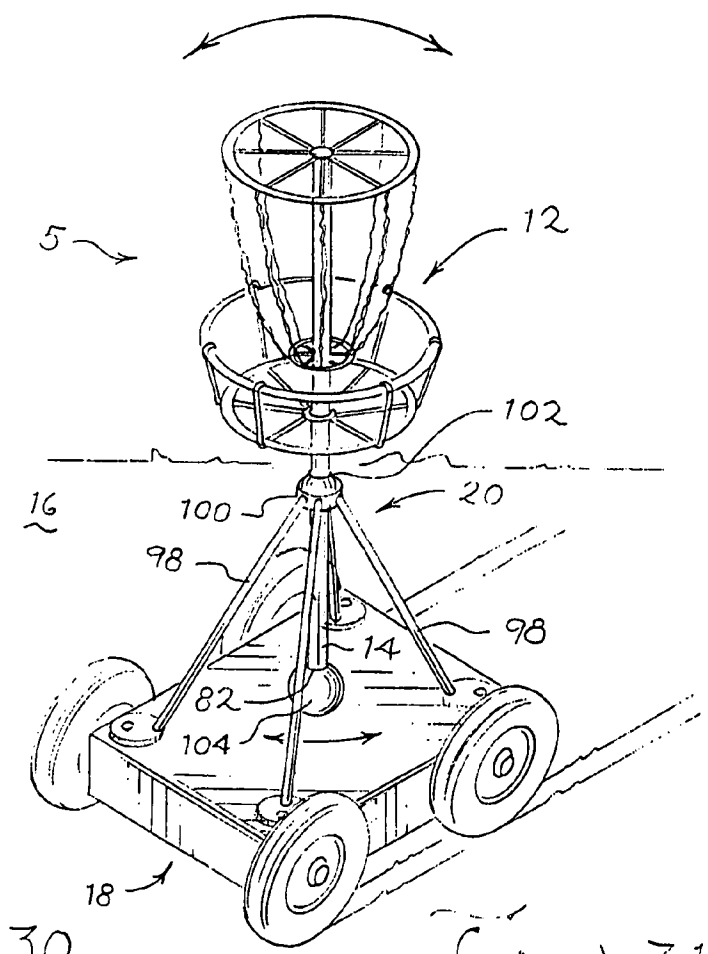
FIG. 31 is a schematic perspective view of the mobile platform having a target assembly connected to the vehicle with another embodiment of the self-righting connector.
Figure 30:
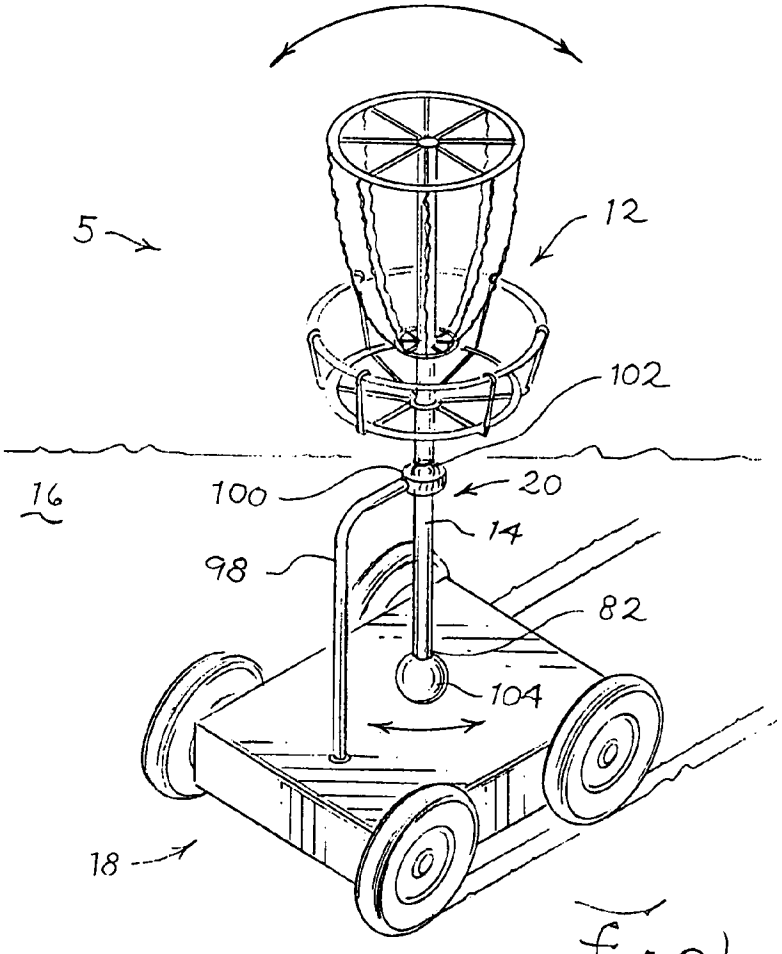
FIG. 30 is a schematic perspective view of the mobile platform having a target assembly connected to the vehicle with a self-righting connector.

In yet another embodiment of the invention illustrated in FIGS. 30 and 31, the connector 20 may be self-righting to enable the target assembly 12 to remain upright (i.e. substantially vertical) when the mobile target 5 is traversing a non-level surface 16. As illustrated in FIG. 30, the connector 20 preferably comprises at least one upright bracket 98 removably connected to the vehicle 18 and supporting multidirectional pivot 100. Although one bracket 98 is shown in the embodiment of FIG. 30, it is understood that additional brackets may be utilized as well (FIG. 31).

Within both figures, the multidirectional pivot 100 is connected to the stand 14 of the target assembly at pivot point 102. A counterweight 104 is located at lower end 82 of the stand 14 to counterbalance the target assembly about the pivot point 102. The multi-directional pivot 100 may comprise any joint that allows for a pendulous movement of the counterweight 104, to include ball and socket joints and universal joints. The location of pivot point 102 on stand 14 is dependent upon the weight of the target and the weight of the counterweight 100.

In addition to having the connector 20 located thereon for connecting the target assembly 12 to the vehicle 18, the cover 30 and/or chassis 26 may also be adapted to hold and carry various accessories, such as drinks, an ice chest, one or more flying discs, and various other accessories.

In use, the target assembly is connected to the vehicle at the connector if not already pre-connected thereto. The vehicle and/or command are then energized through the actuation of respective on/off switches or similar devices. For moving and directing the mobile disc golf target across the playing surface, a command is operated for creating instructions that control the speed and direction of the vehicle carrying the assembly. Instructions are then transmitted via the command and from the command to the controller of the vehicle. Via the instructions created with the command, the propulsion and steering means of the vehicle are influenced by the controller to move and direct the mobile disc golf target to at least one location on the playing surface.

In use in an embodiment of the invention having a user-operated transmitter for the command, the transmitter is operated by a disc golf participant or other individual or party to move the mobile disc golf target to the at least one location on the playing surface. Operating the user-operated transmitter, controls, switches, control sticks and/or control wheels are manipulated to create instructions that control the speed and direction of the vehicle. The instructions are then transmitted from the user-operated transmitter to the controller of the vehicle via antenna and receiver, or via hard-wire or tethered connection. Via the instructions created with the user-operated transmitter, the propulsion and steering means of the vehicle are influenced by the controller to move and direct the mobile disc golf target to at least one location on the playing surface.

FIG. 32 illustrates an aerial schematic view of a disc golf playing course showing various locations of the mobile disc golf target and tee box. In moving and directing the mobile disc golf target with a user-operated transmitter to at least one location on the playing surface 16, the transmitter is manipulated to create instructions that move and direct the mobile disc golf target to at least a first location 106 on the playing surface. A disc golf participant then throws a disc from a first tee box 108 and towards the disc golf target at the at least first location 106. The disc golf participant makes consecutive throws towards the first target until the disc is entrapped by the target itself.

After the disc is entrapped by the target at the first location 106, the user-operated transmitter is again manipulated to move and direct the mobile disc golf target to a next (i.e. second) location 110 on the playing surface 16. The participant moves to the next (i.e. second) tee box 112 and then throws the disc towards the target at the second location 110, again making consecutive throws until the disc is entrapped. Then, preferably in consecutive order, the disc golf participant moves to the remaining tee boxes and the user-operated transmitter is again respectively manipulated to move and direct the mobile disc golf target to the respective remaining locations on the playing surface, with the disc golf participant making respective throws towards the target at the respective locations until the disc is finally entrapped by the target at the final location.

Although the foregoing description recites that a disc golf participant moves to a new tee box before the user-operated transmitter is manipulated to move and direct the mobile disc golf target to the next location, it is understood that the disc golf target may be moved to the next location at any time, i.e. prior to the disc golf participant moving to the next tee or prior to the participant successfully throwing the disc until it is entrapped at that location.

It is further understood that in moving and directing the mobile disc golf target with a user-operated transmitter to at least one location on the playing surface, the transmitter may be manipulated to create instructions that move and direct the mobile disc golf target to any location on the surface. For example, as illustrated in FIG. 32, after a disc is entrapped by the target, the mobile target may be instructed to move to a location 114 proximal to a given tee box (i.e. tee box 112) such that a participant can "retrieve" the disc entrapped therein. Thus, after a disc golf participant successfully throws the disc wherein the disc is entrapped in the target in a given location, the user-operated transmitter may be manipulated to "retrieve" the disc such that the participant does not have to walk to the target to retrieve it.

In use in an embodiment of the invention having a computer-operated transmitter for the command, the computer is programmed by a disc golf participant or other individual or party, or receives a program downloaded by the same from another computer or from a portable medium such as a floppy disc, cartridge or memory card, or from a CD ROM. The computer is then operated to execute the program to create instructions that control the speed and direction of the vehicle. Whether located remotely of the vehicle or on the vehicle itself, the instructions are then transmitted from the computer-operated transmitter to the controller of the vehicle via antenna and receiver, or via hard-wire or tethered connection. Via the instructions created by the computer-operated transmitter, the propulsion and steering means of the vehicle are influenced by the controller to move and direct the mobile disc golf target to at least one location on the playing surface.

In moving and directing the mobile disc golf target with a computer-operated transmitter to at least one location on the playing surface, the computer is programmed or receives a downloaded program that creates instructions that move and direct the mobile disc golf target to at least a first location and any subsequent locations on the playing surface, or to retrieve a disc entrapped therein, as described above for the user-operated transmitter.

While this foregoing description and accompanying drawings are illustrative of the present invention, other variations in structure and method are possible without departing from the invention's spirit and scope.

What is claimed is:

1. A mobile platform for a disc golf target assembly including a substantially upright stand, a basket supported by the stand, and a plurality of chains disposed above the basket, the mobile platform comprising:

a vehicle having a structural rigidity to support at least the target assembly, the target assembly having a weight of between about 20 pounds and about 80 pounds;

a connector generally centrally located on the vehicle for connecting the disc golf target assembly to the vehicle, wherein the connector is self-righting to enable the target assembly to remain substantially vertical when the platform traverses a non-level surface;

a propulsion means and a steering means operably associated with the vehicle, the propulsion means operable to propel the vehicle across a surface and the steering means operable to direct the vehicle across the surface;

a controller operably associated with the propulsion means and the steering means of the vehicle, the controller operable to influence a speed and direction of the vehicle; and a command operable to instruct the controller.

2. The mobile platform of claim 1 wherein the connector is located on a chassis of the vehicle and the chassis has a structural rigidity to support at least the target assembly.

3. The mobile platform of claim 2 wherein the connector comprises a void defined in the chassis and adapted to accept an insertion of a lower end of the stand of the disc golf target assembly therein.

4. The mobile platform of claim 2 wherein the connector comprises a protuberance defined on the chassis and adapted for insertion into a tower end of the stand of the disc golf target assembly.

5. The mobile platform of claim 1 further comprising a cover located on the vehicle.

6. The mobile platform of claim 5 wherein the connector is located on the cover and the cover has a structural rigidity to carry the target assembly.

7. The mobile platform of claim 6 wherein the connector comprises a void defined in the cover and adapted to accept an insertion of a lower end of the stand of the disc golf target assembly therein.

8. The mobile platform of claim 6 wherein the connector comprises a protuberance defined on the cover and adapted for insertion into a lower end of the stand of the disc golf target assembly.

9. The mobile platform of claim 1 wherein the steering means comprises a differential steering arrangement.

10. The mobile platform of claim 9 wherein the vehicle comprises a chassis having a plurality of supports movably associated therewith and in communication with the surface, at least two supports of the plurality operably associated with the propulsion means, the differential steering arrangement comprising a rotation changer operably associated with the propulsion means and at least one support to vary a rotational speed and direction of the at least one support.

11. The mobile platform claim 10 wherein the propulsion means comprises at least one motor operably associated with each of the at least two supports and the rotation changer comprises at least one motor control operably associated with the at least one motor, the at least one motor control under the influence of the controller and operable to vary a rotational speed and direction of the at least one motor.

12. The mobile platform of claim 11 wherein the at least two supports comprise wheels.

13. The mobile platform of claim 11 wherein the at least two supports comprise tread assemblies.

14. The mobile platform of claim 10 wherein the rotation changer comprises a transmission operably associating the at least two supports to the propulsion means, the transmission and the propulsion means under the influence of the controller, the transmission operable to vary a rotational speed and direction of the at least one support.

15. The mobile platform of claim 14 wherein the at least two supports comprise wheels.

16. The mobile platform claim 14 wherein the at least two supports comprise tread assemblies.

17. The mobile platform of claim 1 wherein the steering means comprises a conventional steering arrangement.

18. The mobile platform of claim 17 wherein the vehicle comprises a chassis having a plurality of supports movably associated therewith and in communication with the surface and the conventional steering arrangement comprises a direction changer, at least one support operably associated with the propulsion means and the direction changer of the vehicle, the direction changer and the propulsion means under the influence of the controller, the direction changer operable to adjust an angular orientation of the at least one support in relation to the chassis.

19. The mobile platform of claim 17 wherein the vehicle comprises a chassis having a plurality of supports movably associated therewith and in communication with the surface and the conventional steering arrangement comprises a direction changer, at least one support operably associated with the propulsion means with at least one support operably associated with the direction changer and not associated with the propulsion means, the direction changer and the propulsion means under the influence of the controller, the direction changer operable to adjust an angular orientation of the associated at least one support in relation to the chassis.

20. The mobile platform of claim 19 wherein the direction changer comprises at least one pin rotatably connected to the chassis, the at least one pin having at least one support and a tiller connected thereto, the tiller operably associated with a servo mechanism, the servo mechanism under the influence of the controller to induce a rotational movement of the pin in relation to the chassis.

21. The mobile platform of claim 20 wherein the supports comprise wheels.

22. The mobile platform of claim 1 wherein the command comprises a wireless user-operated transmitter.

23. The mobile platform of claim 1 wherein the command comprises a tethered user-operated transmitter.

24. The mobile platform of claim 1 wherein the command comprises a wireless computer-operated transmitter.

25. A mobile platform for a disc golf target assembly including a substantially upright stand, a basket supported by the stand, and a plurality of chains disposed above the basket, the mobile platform comprising:

a vehicle having a structural rigidity to support at least the target assembly, the target assembly having a weight of between about 20 pounds and about 80 pounds;

a removable connector generally centrally located on the vehicle for connecting the disc golf target assembly to the vehicle, wherein the connector is self-righting to enable the target assembly to remain substantially vertical when the platform traverses a non-level surface;

a propulsion means and a steering means operably associated with the vehicle, the propulsion means operable to propel the vehicle across a surface and the steering means operable to direct the vehicle across the surface;

a controller operably associated with the propulsion means and the steering means of the vehicle, the controller operable to influence a speed and direction of the vehicle; and a command operable to instruct the controller.

26. A mobile disc golf target comprising:

a vehicle;

a disc golf target assembly carried by the vehicle, the disc golf target assembly comprising a substantially upright stand, a basket supported by the stand and a plurality of chains disposed above the basket;

a connector located on the vehicle for connecting the disc golf target assembly to the vehicle wherein the connector is self-righting to enable the target assembly to remain substantially vertical when the vehicle traverses a non-level surface;

a propulsion means and a steering means operably associated with the vehicle, the propulsion means operable to propel the vehicle across a surface and the steering means operable to direct the vehicle across the surface;

a controller operably associated with the propulsion means and the steering means of the vehicle, the controller operable to influence a speed and direction of the vehicle; and a command operable to instruct the controller.

27. The mobile disc golf target of claim 26 wherein the connector is located on a chassis of the vehicle.

28. The mobile disc golf target of claim 26 further comprising a cover located on the vehicle.

29. The mobile disc golf target of claim 28 wherein the connector is located on the cover.

30. The mobile disc golf target assembly of claim 26 wherein the stand includes a height adjustment mechanism.

31. The mobile disc golf target of claim 26 wherein the vehicle is adapted to carry various accessories.

32. The mobile platform of claim 26 wherein the connection of the disc golf target assembly to the vehicle by the connector is removable.

33. A mobile disc golf target comprising:

a vehicle;

a disc golf target assembly carried by the vehicle, the disc golf target assembly comprising a substantially upright stand, a basket supported by the stand, and a plurality of chains disposed above the basket;

a propulsion means and a steering means operably associated with the vehicle, the propulsion means operable to propel the vehicle across a surface and the steering means operable to direct the vehicle across the surface;

a controller operably associated with the propulsion means and the steering means of the vehicle, the controller operable to influence a speed and direction of the vehicle;

a command operable to instruct the controller; and a connector located on the vehicle for connecting the disc golf target assembly to the vehicle wherein the connector is self-righting to enable the target assembly to remain substantially vertical when the vehicle traverses a non-level surface, the self-righting connector comprising at least one bracket connected to the vehicle and supporting a multidirectional pivot, the multidirectional pivot connected to the stand of the target assembly, and a counterweight located at a lower end of the stand.

34. The mobile disc golf target of claim 33 wherein the connection of the at least one bracket to the vehicle is removable.

* * * * *